US008229599B2

(12) United States Patent
Nishino et al.

(10) Patent No.: US 8,229,599 B2
(45) Date of Patent: Jul. 24, 2012

(54) AIR CONDITIONING CONTROL DEVICE AND AIR CONDITIONING CONTROL METHOD

(75) Inventors: Atsushi Nishino, Kusatsu (JP); Satoshi Hashimoto, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 641 days.

(21) Appl. No.: 12/374,704

(22) PCT Filed: Jul. 24, 2007

(86) PCT No.: PCT/JP2007/064507

§ 371 (c)(1),
(2), (4) Date: Jan. 22, 2009

(87) PCT Pub. No.: WO2008/015932

PCT Pub. Date: Feb. 7, 2008

(65) Prior Publication Data

US 2010/0010680 A1 Jan. 14, 2010

(30) Foreign Application Priority Data

Jul. 31, 2006 (JP) ..... 2006-208952
Feb. 23, 2007 (JP) ..... 2007-044183

(51) Int. Cl.
*G05D 7/00* (2006.01)
*F25D 17/06* (2006.01)

(52) U.S. Cl. ..... 700/282

(58) Field of Classification Search ..... 700/282; 62/426

See application file for complete search history.

(56) References Cited

U.S. PATENT DOCUMENTS

| | | | | |
|---|---|---|---|---|
| 6,415,205 | B1 * | 7/2002 | Myron et al. | 700/275 |
| 7,669,433 | B2 * | 3/2010 | Yoon et al. | 62/231 |
| 2006/0010901 | A1 * | 1/2006 | Iwata et al. | 62/426 |
| 2007/0155304 | A1 * | 7/2007 | Hyun et al. | 454/338 |

FOREIGN PATENT DOCUMENTS

| | | | |
|---|---|---|---|
| JP | 05-118614 | A | 5/1993 |
| JP | 06-323594 | A | 11/1994 |
| JP | 2005-134021 | A | 5/2005 |

OTHER PUBLICATIONS

Titus DG-T3SQ-02, T3 Intelligent Comfort Control Products T3SQ VAV Diffusers Deisign Guide, http://files.buildsite.com/dbderived-f/titus/derived_files/derived382482.pdf, Richardson Texas, Jan. 12, 2006.*

(Continued)

*Primary Examiner* — Kakali Chaki
*Assistant Examiner* — Walter Hanchak
(74) *Attorney, Agent, or Firm* — Global IP Counselors

(57) ABSTRACT

An air conditioning control device includes an operating-unit specifying unit, an adjacent-unit specifying unit and an adjacent-unit control unit, and collectively controls the operation of an indoor unit group. The operating-unit specifying unit specifies an operating unit to perform an air conditioning operation from the indoor units included in the indoor unit group. The adjacent-unit specifying unit specifies an adjacent unit adjacent to the operating unit from the indoor units included in the indoor unit group. The adjacent-unit control unit causes the adjacent unit to perform an air flow generating operation. This air flow inhibits air conditioned by the air conditioning operation of the operating unit from diffusing from an air conditioning target space.

20 Claims, 17 Drawing Sheets

OTHER PUBLICATIONS

Sczomak, Dennis and Barry, Tohm, "Underfloor for Technology Firm", http://www.limbachinc.com/images/articles/060620-scmozak.pdf, ASHRAE Journal, Apr. 2006, p. 55-59.*

Toshiba Fie No. A064-005, Toshiba Service Manual Super heat Multi-System Air Conditioner, http://www.toshiba-aircon.co.uk/technical/VRF/SHRM/Installation/SHRM%20(1-series)%20Installation%20Manual%20A04-005.pdf, Tokyo, Jp, printed Oct. 2004.*

HVAC Advanced Products Division, Mitsubishi Electric, "City Multi Variable Refrigerant Flow Zoning System Technology Building Comfort Solutions", Mitsubishi Electric & Electronics USA, Inc., CMTECH-12-08-29M-V3 PD, 2008, pp. 64.*

* cited by examiner

21

| | ADJACENT UNITS | | | |
|---|---|---|---|---|
| INDOOR UNIT 30a | INDOOR UNIT 30b | INDOOR UNIT 30f | | |
| INDOOR UNIT 30b | INDOOR UNIT 30a | INDOOR UNIT 30c | INDOOR UNIT 30g | |
| . . . | . . . | . . . | | |
| INDOOR UNIT 30g | INDOOR UNIT 30b | INDOOR UNIT 30f | INDOOR UNIT 30h | INDOOR UNIT 30l |
| . . . | . . . | . . . | | |
| INDOOR UNIT 30y | INDOOR UNIT 30t | INDOOR UNIT 30x | | |

FIG. 3

22

| | ADJACENT UNITS | | | |
|---|---|---|---|---|
| | FLAP 31a | FLAP 31b | FLAP 31c | FLAP 31d |
| INDOOR UNIT 30a | | | INDOOR UNIT 30b | INDOOR UNIT 30f |
| INDOOR UNIT 30b | | INDOOR UNIT 30a | INDOOR UNIT 30c | INDOOR UNIT 30g |
| . . . | | . . . | | |
| INDOOR UNIT 30g | INDOOR UNIT 30b | INDOOR UNIT 30f | INDOOR UNIT 30h | INDOOR UNIT 30l |
| . . . | | . . . | | |
| INDOOR UNIT 30y | INDOOR UNIT 30t | INDOOR UNIT 30x | | |

FIG. 8

AIR CONDITIONING CONTROL DEVICE AND AIR CONDITIONING CONTROL METHOD

CROSS-REFERENCE TO RELATED APPLICATIONS

This U.S. National stage application claims priority under 35 U.S.C. §119(a) to Japanese Patent Application Nos. 2006-208952, filed in Japan on Jul. 31, 2006, 2007-044183, filed in Japan on Feb. 23, 2007, the entire contents of which are hereby incorporated herein by reference.

TECHNICAL FIELD

The present invention relates to an air conditioning control device and an air conditioning control method that collectively control the operation of an indoor unit group constituted by a plurality of indoor units of an air conditioner that are installed in a single space.

BACKGROUND ART

Conventionally, when air conditioning is performed in a single large open space such as an office, restaurant, and the like, a plurality of indoor units may be installed in such a space. Usually, the operation of each indoor unit can be individually set. Therefore, when a plurality of indoor units are installed in a single large open space and if air conditioning is needed only in the space of a portion of such a single large open space, among all the indoor units installed in the single large open space, only the indoor unit arranged for the space of the portion is caused to perform an air conditioning operation.

Meanwhile, JP-A Publication No. H6-323594 discloses an air curtain generating device that generates an air curtain for separating the space to be targeted by an air conditioning operation from other spaces in order to improve the air conditioning operational efficiency in the space to be targeted by the air conditioning operation.

SUMMARY OF THE INVENTION

Object to be Achieved by the Present Invention

However, when only the space of a portion of a single large open space is to be air conditioned by an indoor unit arranged for the space of the portion, air conditioned by the indoor unit arranged for the space of the portion diffuses into a nearby space. As a result, a space where air conditioning is not needed may be air conditioned.

When an attempt to introduce an air curtain generating device such as the one described in patent document 1 is made in order to separate the space of the portion as described above, it will create new problems such as difficulty in securing an installation space, high cost, and the like. In addition, even if these problems were overcome, if the location of the space to be separated cannot be determined in advance, it is impossible to specify the location where the air curtain generating device should be introduced. Thus, in practice, it is quite difficult to introduce the air curtain generating device.

An object of the present invention is to improve the air conditioning operational efficiency in the space of a portion of a single space having an indoor unit group installed when air conditioning is needed only in the space of the portion, and to facilitate energy conservation.

Means to Achieve the Object

An air conditioning control device according to a first aspect of the present invention includes an operating-unit specifying unit, an adjacent-unit specifying unit, an operating-unit control unit, and an adjacent-unit control unit, and collectively controls the operation of an indoor unit group. The indoor unit group is constituted by a plurality of indoor units of an air conditioner that are installed in a single space. The operating-unit specifying unit specifies, among the indoor units included in the indoor unit group, an operating unit that is an indoor unit to perform an air conditioning operation. The adjacent-unit specifying unit specifies, among the indoor units included in the indoor unit group, an adjacent unit that is an indoor unit adjacent to the operating unit. The operating-unit control unit causes the operating unit to perform the air conditioning operation. The adjacent-unit control unit causes the adjacent unit to perform an air flow generating operation. The air flow generating operation is an operation to generate an air flow. This air flow inhibits air conditioned by the air conditioning operation of the operating unit from diffusing from an air conditioning target space. The air conditioning target space is a portion of a single space where the indoor unit group is installed, and is a space which is targeted by the air conditioning operation of the operating unit.

With this air conditioning control device, an indoor unit (operating unit) capable of air conditioning a space required to be air conditioned (air conditioning target space) within a single space where the plurality of indoor units are installed is caused to perform the air conditioning operation. Further, this air conditioning control device causes an indoor unit (adjacent unit) adjacent to the operating unit to perform the air flow generating operation. Note that the adjacent unit may be located either inside or outside the air conditioning target space. The adjacent unit performs the air flow generating operation and thereby generates an air flow that inhibits conditioned air from diffusing from the air conditioning target space. Accordingly, with this air conditioning control device, when air conditioning is needed only in the space of a portion of a single space having the indoor unit group installed, it is possible to improve the air conditioning operational efficiency in the space of the portion and facilitate energy conservation.

An air conditioning control device according to a second aspect of the present invention is the air conditioning control device according to the first aspect of the present invention, wherein the air flow generating operation is a thermo-off operation.

This air conditioning control device causes the adjacent unit to perform the thermo-off operation as the air flow generating operation, i.e., an operation in an air blowing mode where only blowing of air is performed. Accordingly, with this air conditioning control device, it is possible to generate an air flow that inhibits conditioned air from diffusing from the air conditioning target space.

An air conditioning control device according to a third aspect of the present invention is the air conditioning control device according to the first aspect of the present invention, wherein the air flow generating operation is a mild cooling operation or a mild heating operation.

This air conditioning control device causes the adjacent unit to perform the mild cooling operation or the mild heating operation as the air flow generating operation. Accordingly, with this air conditioning control device, it is possible to aid the cooling operation or the heating operation of the operating unit while inhibiting conditioned air from diffusing from the air conditioning target space, by generating an air flow of air mildly cooled or mildly heated.

An air conditioning control device according to a fourth aspect of the present invention is the air conditioning control device according to any one of the first through third aspects of the present invention, wherein the adjacent unit is installed in a ceiling of the space where the indoor unit group is installed. The air flow generating operation is an air blowing operation to blow air downward or obliquely downward.

This air conditioning control device causes the adjacent unit to blow air downward or obliquely downward as the air flow generating operation. Accordingly, with this air conditioning control device, an air curtain is formed at a boundary between the air conditioning target space and the space outside thereof, and it is possible to more effectively inhibit conditioned air from diffusing from the air conditioning target space.

An air conditioning control device according to a fifth aspect of the present invention is the air conditioning control device according to any one of the first through fourth aspects of the present invention, further including an operation command input unit. The operation command input unit allows a user to input an operation command to the indoor units included in the indoor unit group. The operating-unit specifying unit specifies the operating unit based on the operation command input via the operation command input unit.

With this air conditioning control device, the operating unit is specified based on the operation command input by the user via the operation command input unit. The operation command input unit may be, for example, an individual remote controller for controlling each indoor unit or a central remote controller for controlling a plurality of indoor units. Accordingly, with this air conditioning control device, the operating unit can manually be specified by the user.

An air conditioning control device according to a sixth aspect of the present invention is the air conditioning control device according to any one of the first through fourth aspects of the present invention, further including a living body location identifying unit. The living body location identifying unit identifies the location of a living body present in the space where the indoor unit group is installed. The operating-unit specifying unit specifies the operating unit based on the location of the living body identified by the living body location identifying unit.

With this air conditioning control device, the operating unit is specified based on the location of a living body present in the space where the indoor unit group is installed, which is identified by the living body location identifying unit. Accordingly, with this air conditioning control device, it is possible to automatically specify the operating unit.

An air conditioning control device according to a seventh aspect of the present invention is the air conditioning control device according to any one of the first through sixth aspects of the present invention, wherein the adjacent unit includes a plurality of air blow-out direction adjusting elements (means). The air blow-out direction adjusting elements (means) adjust the direction of air blown out from the adjacent unit. The air flow generating operation is an operation to generate the above described air flow by independently controlling the plurality of air blow-out direction adjusting elements (means) such that air is blown out from the adjacent unit only in the direction toward the air conditioning target space.

The adjacent unit controlled by this air conditioning control device is equipped with the plurality of air blow-out direction adjusting elements (means) capable of being operated in a mutually independent manner. The air blow-out direction adjusting elements (means) are, for example, flaps that open and close a blow-out port formed in a casing of the indoor unit. This air conditioning control device causes the adjacent unit to blow out air only in the direction from the adjacent unit toward the air conditioning target space by separately controlling the plurality of air blow-out direction adjusting elements (means), and inhibits the adjacent unit from blowing air in directions not toward the air conditioning target space. Accordingly, with this air conditioning control device, it is possible to further facilitate energy conservation by inhibiting the adjacent unit from unnecessarily blowing air.

An air conditioning control device according to an eighth aspect of the present invention is the air conditioning control device according to any one of the first through seventh aspects of the present invention, wherein, when a plurality of indoor units are specified as the operating units by the operating-unit specifying unit, the adjacent-unit specifying unit specifies only an indoor unit that is not the operating unit as the adjacent unit, among all the indoor units adjacent to at least one of the operating units. Among the plurality of indoor units specified as the operating units by the operating-unit specifying unit, the operating-unit control unit causes the indoor unit adjacent to the adjacent unit to perform the air conditioning operation at reduced performance level compared to the other indoor units not adjacent to the adjacent unit.

Air in a space that is inside the air conditioning target space and that is near the boundary between the air conditioning target space and the space outside thereof tends to easily flow out of the air conditioning target space. Consequently, with this air conditioning control device, among all the indoor units arranged for the air conditioning target space, the indoor unit arranged for the space near the boundary is caused to perform an air conditioning operation at reduced performance level compared to the indoor unit arranged for the space that is more inward than the space near the boundary. Accordingly, with this air conditioning control device, it is possible to improve the air conditioning operational efficiency in the air conditioning target space.

An air conditioning control device according to a ninth aspect of the present invention is the air conditioning control device according to any one of the first through eighth aspects of the present invention, further including a memory unit. The memory unit stores arrangement information. The arrangement information is information regarding the arrangement of the indoor units included in the indoor unit group in the space where the indoor unit group is installed. The adjacent-unit specifying unit specifies the adjacent unit based on the arrangement information stored in the memory unit.

This air conditioning control device stores the arrangement information of the indoor units constituting the indoor unit group. Accordingly, with this air conditioning control device, the adjacent unit among the indoor units can be specified.

An air conditioning control device according to a tenth aspect of the present invention is the air conditioning control device according to the first aspect of the present invention, wherein the operating unit and the adjacent unit are present in the air conditioning target space.

This air conditioning control device causes the adjacent unit that is an indoor unit in the air conditioning target space to perform the air flow generating operation. In other words, it is possible to further facilitate energy conservation by not allowing the adjacent unit to perform a normal air conditioning operation.

An air conditioning control device according to an eleventh aspect of the present invention is the air conditioning control device according to the tenth aspect of the present invention, wherein the operating-unit control unit causes the operating unit to perform a cooling operation. The adjacent-unit control unit controls the direction of air from the adjacent unit so as to be directed toward a living body in the vicinity of the adjacent unit.

During the cooling operation of the operating unit, this air conditioning control device causes the adjacent unit to blow out air in the direction toward the living body in the vicinity of the adjacent unit. Therefore, even if the temperature in the space in the vicinity of the adjacent unit is raised as a result of the adjacent unit not performing the normal air conditioning operation, the sensible temperature as felt by the living body in the vicinity of the adjacent unit can be lowered.

An air conditioning control device according to a twelfth aspect of the present invention is the air conditioning control device according to the tenth aspect of the present invention, wherein the adjacent unit is installed in a ceiling of the space. The operating-unit control unit causes the operating unit to perform the cooling operation. The operating-unit control unit controls the direction of air from the operating unit so as to be directed toward the adjacent unit.

This air conditioning control device causes the operating unit to blow out cold air toward the adjacent unit arranged in the ceiling. Accordingly, in the air conditioning target space, heavy cold air is accumulated near the ceiling and the cold air gradually descends to near the floor. Thus, it is possible to uniformly cool the air conditioning target space.

An air conditioning control device according to a thirteenth aspect of the present invention is the air conditioning control device according to the tenth aspect of the present invention, wherein the adjacent unit has a suction port for sucking air and a plurality of air blow-out direction adjusting elements (means). The air blow-out direction adjusting elements (means) adjust the direction of air blown out. The air flow generating operation is an operation to generate the air flow only from the air blow-out direction adjusting elements (means) farther from the operating unit than the suction port, among the plurality of air blow-out direction adjusting elements (means).

The adjacent unit controlled by this air conditioning control device is equipped with the plurality of air blow-out direction adjusting elements (means) capable of being operated in a mutually independent manner. The air blow-out direction adjusting elements (means) are, for example, flaps that open and close a blow-out port formed in a casing of the indoor unit. This air conditioning control device generates the air flow only from the air blow-out direction adjusting elements (means) located at a position far from the operating unit compared to the suction port, and inhibits air from being blown out from the air blow-out direction adjusting elements (means) located at a position close to the operating unit compared to the suction port, among the plurality of blow-out direction adjusting elements (means). Accordingly, with this air conditioning control device, air conditioned by the operating unit can easily reach the space in the vicinity of the adjacent unit.

An air conditioning control method according to a fourteenth aspect of the present invention includes an operating unit specifying step, an adjacent unit specifying step, a first controlling step, and a second controlling step, and collectively controls the operation of an indoor unit group. The indoor unit group is constituted by a plurality of indoor units of an air conditioner that are installed in a single space. The operating unit specifying step specifies an operating unit that is an indoor unit to perform an air conditioning operation, among the indoor units included in the indoor unit group. The adjacent unit specifying step specifies, among the indoor units included in the indoor unit group, an adjacent unit that is an indoor unit adjacent to the operating unit. The first controlling step causes the operating unit to perform the air conditioning operation. The second controlling step causes the adjacent unit to perform an air flow generating operation. The air flow generating operation is an operation to generate an air flow. This air flow inhibits air conditioned by the air conditioning operation of the operating unit from diff-using from an air conditioning target space. The air conditioning target space is a portion of a single space where the indoor unit group is installed, and is a space which is targeted by the air conditioning operation of the operating unit.

With this air conditioning control method, an indoor unit (operating unit) capable of air conditioning a space required to be air conditioned (air conditioning target space) within a single space where a plurality of indoor units are installed is caused to perform the air conditioning operation. Additionally, with this air conditioning control method, an indoor unit (adjacent unit) adjacent to the operating unit is caused to perform the air flow generating operation. Note that the adjacent unit may be located either inside or outside the air conditioning target space. The adjacent unit performs the air flow generating operation and thereby generates an air flow that inhibits conditioned air from diff-using from the air conditioning target space. Accordingly, with this air conditioning control method, when air conditioning is needed only in the space of a portion of a single space having the indoor unit group installed, it is possible to improve the air conditioning operational efficiency in the space of the portion and facilitate energy conservation.

EFFECTS OF THE INVENTION

With the air conditioning control device according to the first aspect of the present invention, when air conditioning is needed only in the space of a portion of a single space having the indoor unit group installed, it is possible to improve the air conditioning operational efficiency in the space of the portion and facilitate energy conservation.

With the air conditioning control device according to the second aspect of the present invention, it is possible to generate an air flow that inhibits conditioned air from diffusing from the air conditioning target space.

With the air conditioning control device according to the third aspect of the present invention, it is possible to aid the cooling operation or the heating operation of the operating unit while inhibiting conditioned air from diff-using from the air conditioning target space, by generating an air flow of air mildly cooled or mildly heated.

With the air conditioning control device according to the fourth aspect of the present invention, an air curtain is formed at a boundary between the air conditioning target space and the space outside thereof, and it is possible to more effectively inhibit conditioned air from diffusing from the air conditioning target space.

With the air conditioning control device according to the fifth aspect of the present invention, the operating unit can manually be specified by the user.

With the air conditioning control device according to the sixth aspect of the present invention, the operating unit can be automatically specified.

With the air conditioning control device according to the seventh aspect of the present invention, it is possible to further facilitate energy conservation by inhibiting the adjacent unit from unnecessarily blowing air.

With the air conditioning control device according to the eighth aspect of the present invention, it is possible to improve the air conditioning operational efficiency in the air conditioning target space.

With the air conditioning control device according to the ninth aspect of the present invention, the adjacent unit among the indoor units can be specified.

With the air conditioning control device according to the tenth aspect of the present invention, it is possible to further facilitate energy conservation by not allowing the adjacent unit to perform the normal air conditioning operation.

With the air conditioning control device according to the eleventh aspect of the present invention, even if the temperature in the space in the vicinity of the adjacent unit is raised as a result of the adjacent unit not performing the normal air conditioning operation, the sensible temperature as felt by the living body in the vicinity of the adjacent unit can be lowered.

With the air conditioning control device according to the twelfth aspect of the present invention, it is possible to uniformly cool the air conditioning target space.

With the air conditioning control device according to the thirteenth aspect of the present invention, air conditioned by the operating unit can easily reach the space in the vicinity of the adjacent unit.

With the air conditioning control method according to the fourteenth aspect of the present invention, when air conditioning is needed only in the space of a portion of a single space having the indoor unit group installed, it is possible to improve the air conditioning operational efficiency in the space of the portion and facilitate energy conservation.

BRIEF DESCRIPTION OF THE DRAWINGS

FIG. 3 is a view showing an arrangement information management table according to the first embodiment of the present invention.

FIG. 8 is a view showing an arrangement information management table according to an alternative embodiment (4) of the first embodiment of the present invention.

FIG. 15(*b*) is a view showing a different setting of the indoor space to which air conditioning control according to the alternative embodiment (3) of the second embodiment of the present invention is being applied.

DETAILED DESCRIPTION OF THE INVENTION

First Embodiment

An air conditioning control device 1 according to a first embodiment of the present invention is described below.

<Installation Environment of Air Conditioning Control Device>

Figure 1:
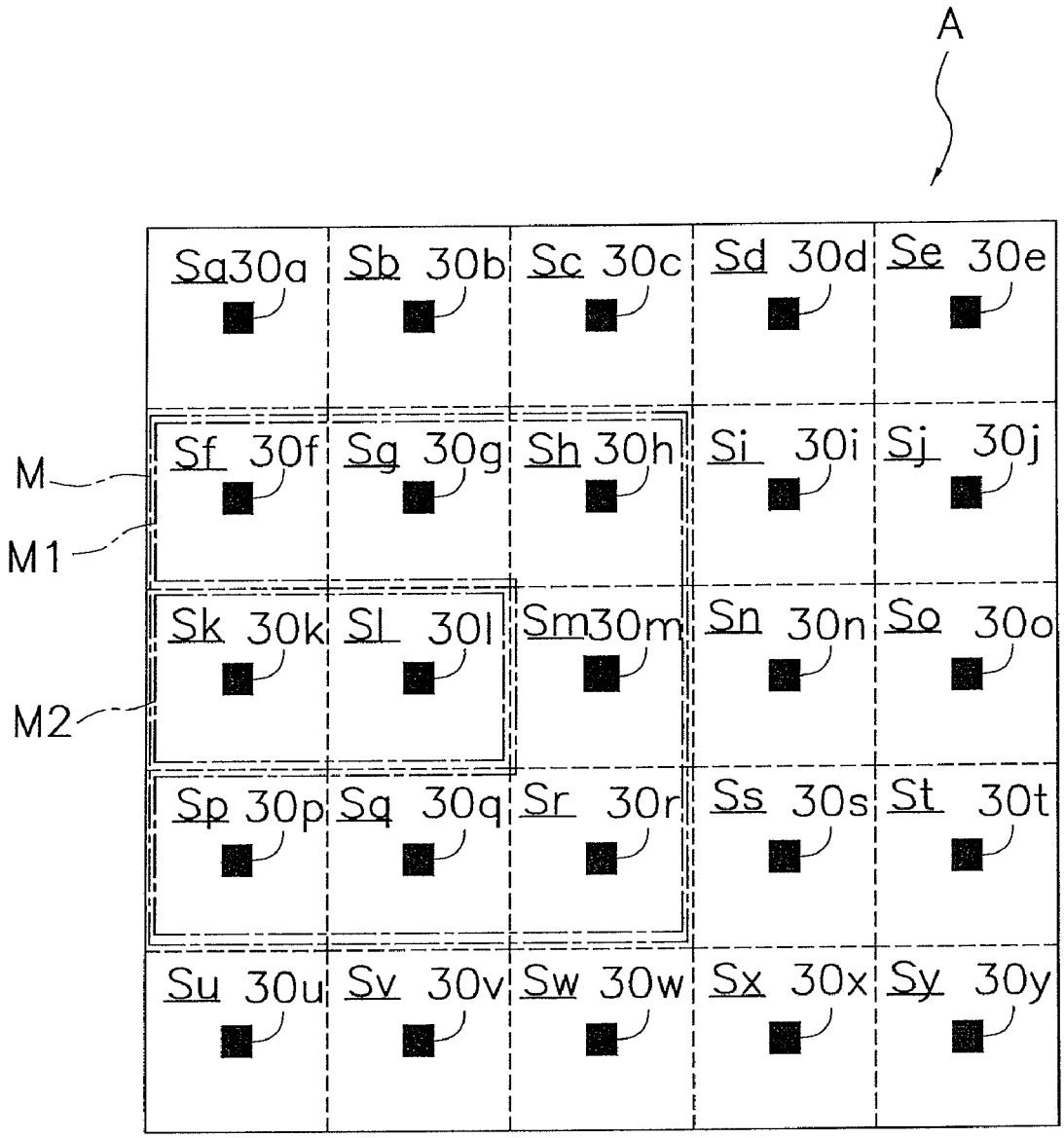
FIG. 1 is a view showing the setting of an indoor space where indoor units of an air conditioner controlled by an air conditioning control device according to a first embodiment of the present invention are installed.

FIG. 1 shows the setting of an indoor space A where indoor units 30*a*, 30*b*, . . . , and 30*y* of an air conditioner controlled by the air conditioning control device 1 are installed. The indoor space A is a single large open space such as an office, restaurant, and the like.

In the ceiling of the indoor space A, the plurality of indoor units 30*a*, 30*b*, . . . , and 30*y* are embedded at appropriate intervals. In FIG. 1, cell spaces Sa, Sb, . . . , and Sy partitioned by broken lines are spaces that are virtually divided, and correspond to respectively the indoor units 30*a*, 30*b*, . . . , and 30*y*. The cell spaces Sa, Sb, . . . , and Sy are spaces which is targeted by an air conditioning operation of the indoor units 30*a*, 30*b*, . . . , and 30*y* respectively. The indoor units 30*a*, 30*b*, . . . , and 30*y* are installed inside of the cell spaces Sa, Sb, . . . , and Sy respectively.

<Configuration of Air Conditioning Control Device>

Figure 2:
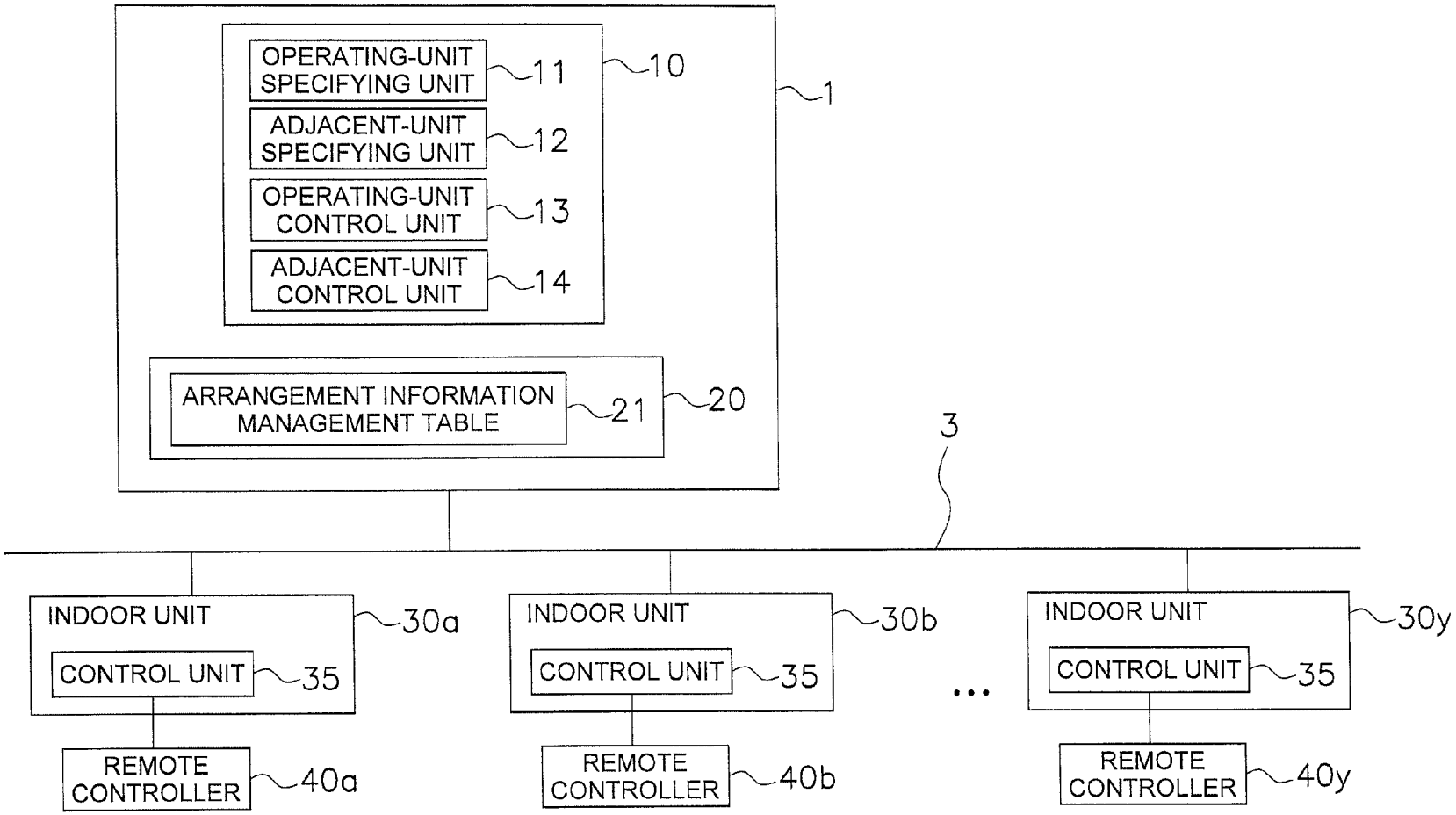
FIG. 2 is a block diagram showing a configuration of the air conditioning control device according to the first embodiment of the present invention.

FIG. 2 is a block diagram showing the configuration of the air conditioning control device 1. The air conditioning control device 1 has a control unit 10 and a memory unit 20. The air conditioning control device 1 is connected to a control unit 35 of each of the indoor units 30*a*, 30*b*, . . . , and 30*y* via a communication network 3, and is capable of controlling the operation of each portion of each of the indoor units 30*a*, 30*b*, . . . , and 30*y* via the control unit 35. This communication network 3 may be a network dedicated to air conditioning to which only the air conditioning control device 1 and equipment such as the indoor units 30*a*, 30*b*, . . . , and 30*y* are connected, or may be a general network compliant with standards such as Ethernet (registered trademark).

By reading out and executing a control program stored in the memory unit 20, the control unit 10 operates as an operating-unit specifying unit 11, an adjacent-unit specifying unit 12, an operating-unit control unit 13, an adjacent-unit control unit 14 and the like. Details of the operation of each of these units 11 to 14 are described later.

The memory unit 20 stores an arrangement information management table 21 that organizes information regarding the arrangement of the indoor units 30*a*, 30*b*, . . . , and 30*y* in the indoor space A. As shown in FIG. 3, the arrangement information management table 21 manages information as one line data that associates each one of the indoor units 30*a*, 30*b*, . . . , and 30*y* with a maximum of four indoor units 30*a*, 30*b*, . . . , and 30*y* adjacent to the one of the indoor units 30*a*, 30*b*, . . . , and 30*y*.

<Configuration of Air Conditioner>

The indoor unit 30*a* is mainly described below; however, the same description applies to other indoor units 30*b*, . . . , 30*y*.

Figure 4:
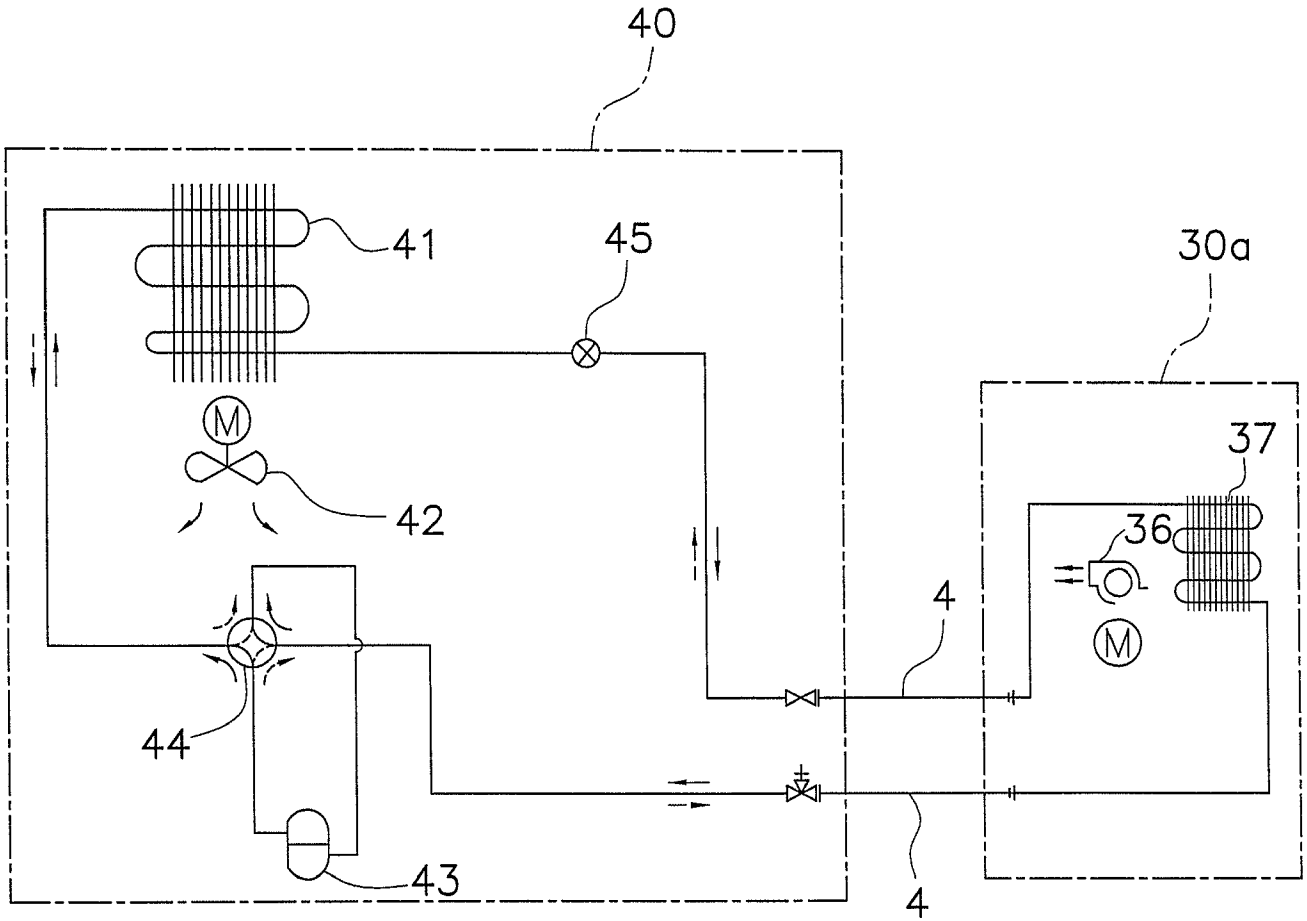
FIG. 4 is a view showing a configuration of the air conditioner according to the first embodiment of the present invention.

As shown in FIG. 4, the indoor unit 30*a* is connected to an outdoor unit 40 via a refrigerant communication pipe 4. Note that the air conditioner controlled by the air conditioning control device 1 is a multi system air conditioner and the indoor units 30*a*, 30*b*, . . . , and 30*y* are connected in parallel; however, the illustrations thereof are omitted in FIG. 4 for the sake of simplicity.

An indoor fan 36 rotationally driven by a fan motor is provided in a casing of the indoor unit 30*a*, and air in the cell space Sa is sucked into the casing of the indoor unit 30*a* via a suction port 33 (see FIG. 5) as a result of rotation of the indoor fan 36. The air sucked into the casing of the indoor unit 30*a* exchanges heat with the refrigerant flowing through an indoor side heat exchanger 37 disposed in the casing of the indoor unit 30*a*. Consequently, the air is cooled during operation in a cooling mode (when a four way valve 44 of the outdoor unit 40 is in a state shown by solid lines) and is heated during operation in a heating mode (when the four way valve 44 of the outdoor unit 40 is in a state shown by broken lines).

On the other hand, the refrigerant that has exchanged heat in the indoor side heat exchanger 37 is sent to the outdoor unit 40 via the refrigerant communication pipe 4. In a casing of the outdoor unit 40, there are provided an outdoor side heat exchanger 41, an outdoor fan 42, a compressor 43, a four way valve 44, and an expansion valve 45. As a result of the outdoor fan 42 being rotationally driven by the fan motor, outdoor air is sucked into the casing of the outdoor unit 40, and heat exchange is facilitated between the air sucked into and the refrigerant flowing through the outdoor side heat exchanger 41. The refrigerant flowing through the outdoor side heat exchanger 41 radiates heat during operation in the cooling mode (when the four way valve 44 of the outdoor unit 40 is in a state shown by solid lines) and absorbs heat during operation in the heating mode (when the four way valve 44 of the outdoor unit 40 is in a state shown by broken lines).

Figure 5:
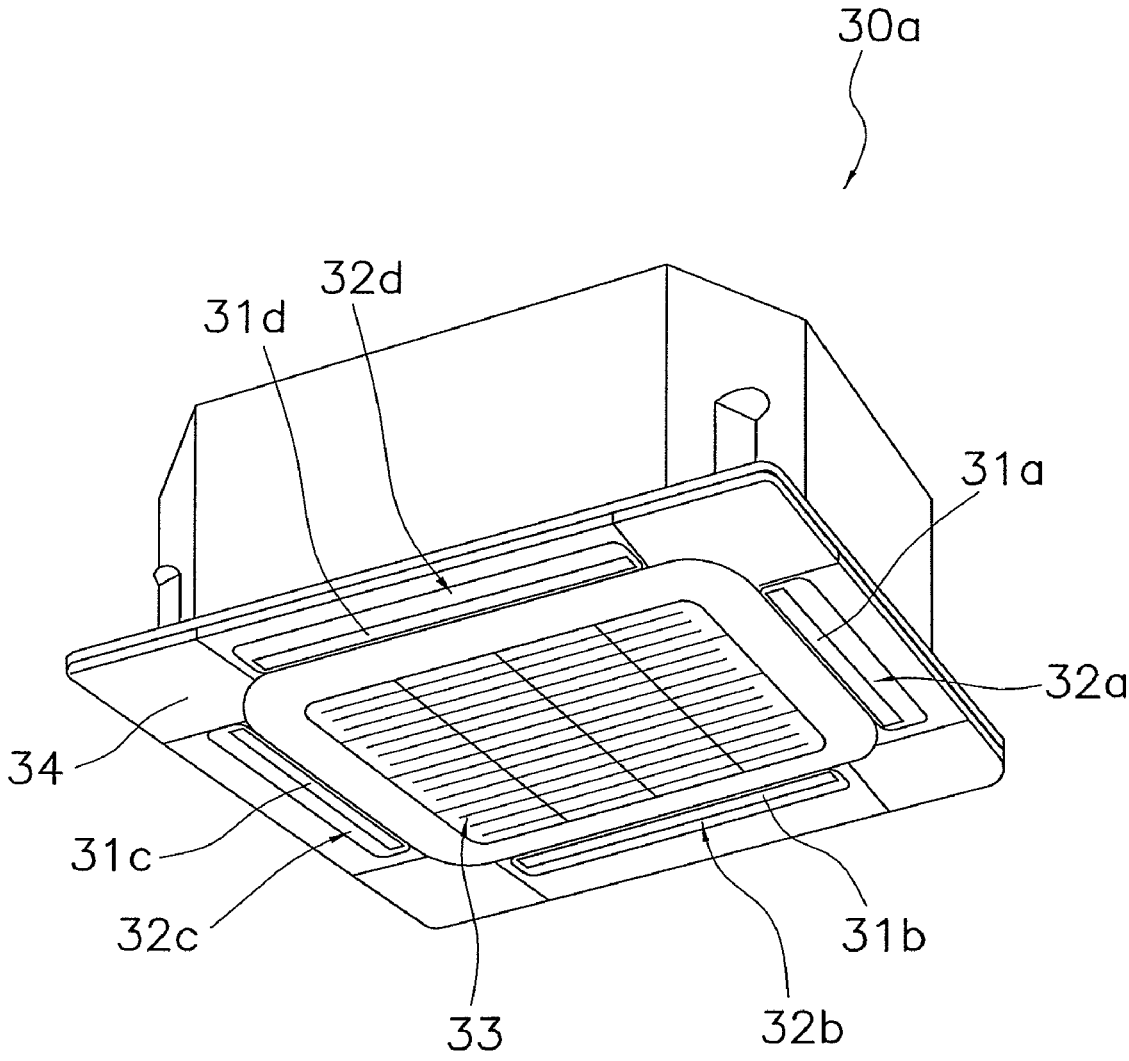
FIG. 5 is an external view of the indoor unit according to the first embodiment of the present invention.

FIG. 5 is an external view of the indoor unit 30*a*. The suction port 33 for sucking air in the cell space Sa and four blow-out ports 32*a* to 32*d* for blowing out air into the cell space Sa are formed in a bottom panel 34 of the casing of the indoor unit 30*a*. The bottom panel 34 is a decorative panel facing the indoor space A, and has a generally quadrangular shape. The four blow-out ports 32*a* to 32*d* are formed one each along the four sides of the generally quadrangular bottom panel 34, and surround the suction port 33 formed in a generally quadrangular shape in the center of the bottom panel 34. In addition, the bottom panel 34 is provided with flaps 31*a* to 31*d* (a plurality of air blow-out direction adjusting elements or means) that open and close blow-out ports 32*a* to 32*d*, respectively. The flow direction of air blown out from the indoor unit 30*a* is determined by the inclination of the flaps 31*a* to 31*d*.

With reference to FIG. 2 once again, the indoor unit 30*a* has the control unit 35. The control unit 35 is connected to a motor that opens and closes the flaps 31*a* to 31*d*, and can control the opening and closing of the flaps 31*a* to 31*d*. In addition, the control unit 35 is connected to the fan motor that rotationally drives the indoor fan 36, and can control the rotation speed of the indoor fan 36. Further, the control unit 35 can communicate with a remote controller 40*a* in a wire or wireless manner. The user can input operation commands such as on/off of the operation, operation mode, set temperature, air volume, direction of air, and the like to the indoor unit 30*a* via the remote controller 40*a*. Note that, although FIG. 2 illustrates the remote controllers 40*a*, 40*b*, . . . , and 40*y* being provided respectively correspondingly to the indoor units 30*a*, 30*b*, . . . , and 30*y*, any number of remote controllers may be provided in other embodiments.

<Operation of Air Conditioning Control Device>

Figure 6:
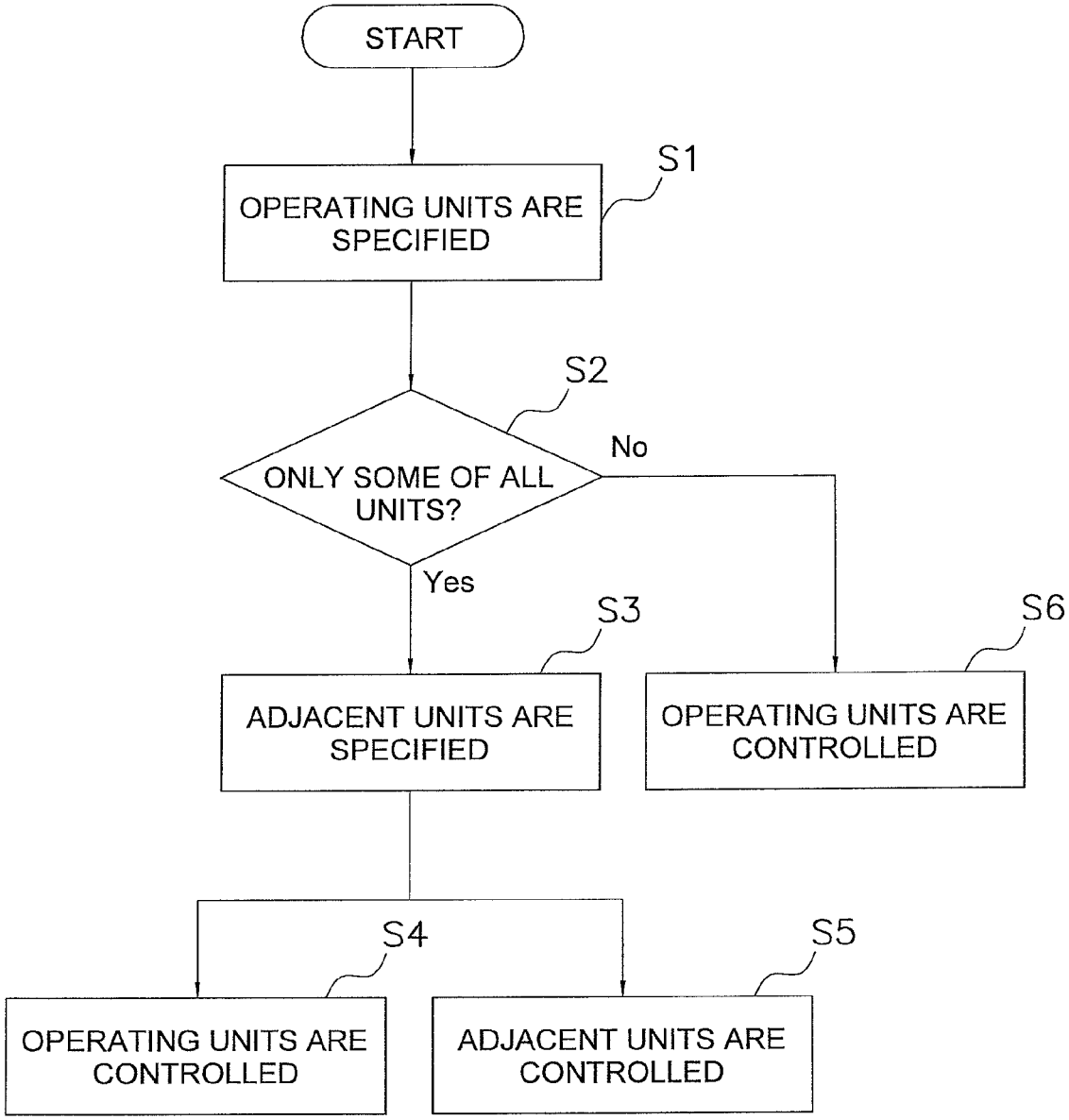
FIG. 6 is a flowchart showing the flow of the process in which the air conditioning control device according to the first embodiment of the present invention controls the indoor units.

FIG. 6 is a flowchart showing the flow of the process in which the air conditioning control device 1 controls the indoor units 30*a*, 30*b*, . . . , and 30*y* of the air conditioner. This process is started when the user started or stopped any type of operation of the indoor units 30*a*, 30*b*, . . . , and 30*y* via the remote controllers 40*a*, 40*b*, . . . , and 40*y* (note that an operation in an air blowing mode where only blowing of air is performed is excluded, and the same applies throughout to the description of the first embodiment unless otherwise explicitly stated). The operation commands input into the remote controllers 40*a*, 40*b*, . . . , and 40*y* by the user are sent to the control unit 10 of the air conditioning control device 1 via the control unit 35 of the indoor units 30*a*, 30*b*, . . . , and 30*y*, respectively, and the communication network 3.

The process shown in FIG. 6 is described below by taking, as a specific example, the case in which the user requires air conditioning only in a space M (see FIG. 1) constituted by the cell spaces Sf to Sh, Sk to Sm, and Sp to Sr within the indoor space A. In this specific example, the user selects the operation of the indoor units 30*f* to 30*h*, 30*k* to 30*m*, and 30*p* to 30*r* installed in the space M, among all the indoor units 30*a*, 30*b*, . . . , and 30*y* installed in the indoor space A, via the remote controllers 40*a*, 40*b*, . . . , and 40*y*. In other words, the space M is an air conditioning target space where the user requires air conditioning. For example, the space M is an occupied space where the user is present, and the cell spaces Sa to Se, Si, Sj, Sn, So, Ss, St, and Su to Sy that are not included in the space M are vacant spaces where the user is not present.

In step S1, the control unit 10 operates as the operating-unit specifying unit 11. Based on the operation commands sent from the remote controllers 40*a*, 40*b*, . . . , and 40*y*, the operating-unit specifying unit 11 specifies, among all the indoor units 30*a*, 30*b*, . . . , and 30*y*, the indoor units 30*f* to 30*h*, 30*k* to 30*m*, and 30*p* to 30*r* being currently selected by the user to operate (hereinafter referred to as "operating units").

Next, in step S2, the control unit 10 determines whether or not the operating units 30*f* to 30*h*, 30*k* to 30*m*, and 30*p* to 30*r* specified in step S1 are only some of all the indoor units 30*a*, 30*b*, . . . , and 30*y*. When they are only some of all, in other words, when only some of all indoor units are currently selected by the user to operate, the process proceeds to step S3, otherwise to step S6. In case of the above described specific example, the process proceeds to step S3.

In step S3, the control unit 10 operates as the adjacent-unit specifying unit 12. The adjacent-unit specifying unit 12 specifies the indoor units 30*a* to 30*c*, 30*i*, 30*n*, 30*s*, and 30*u* to 30*w* (hereinafter referred to as "adjacent units") adjacent to the operating units 30*f* to 30*h*, 30*k* to 30*m*, and 30*p* to 30*r* specified in step SI. Note that the indoor units specified as the adjacent units in step S3 are the indoor units 30*a* to 30*c*, 30*i*, 30*n*, 30*s*, and 30*u* to 30*w* that are not the operating units 30*f* to 30*h*, 30*k* to 30*m*, and 30*p* to 30*r*, among all the indoor units 30*a* to 30*c*, 30*f* to 30*i*, 30*k* to 30*n*, 30*p* to 30*s*, and 30*u* to 30*w* adjacent to any of the operating units 30*f* to 30*h*, 30*k* to 30*m*, and 30*p* to 30*r*. More specifically, the adjacent-unit specifying unit 12 refers to the arrangement information management table 21 stored in the memory unit 20 and specifies all the indoor units 30*a* to 30*c*, 30*f* to 30*i*, 30*k* to 30*n*, 30*p* to 30*s*, and 30*u* to 30*w* adjacent to any of the operating units 30*f* to 30*h*, 30*k* to 30*m*, and 30*p* to 30*r*. Then, the adjacent-unit specifying unit 12 excludes the operating units 30*f* to 30*h*, 30*k* to 30*m*, and 30*p* to 30*r* from all the specified indoor units 30*a* to 30*c*, 30*f* to 30*i*, 30*k* to 30*n*, 30*p* to 30*s*, and 30*u* to 30*w* so as to specify the adjacent units 30*a* to 30*c*, 30*i*, 30*n*, 30*s*, and 30*u* to 30*w*. Note that the adjacent units 30*a* to 30*c*, 30*i*, 30*n*, 30*s*, and 30*u* to 30*w* are present in an adjacent space (cell spaces Sa to Sc, Si, Sn, Ss, and Su to Sw) adjacent to the space M. The adjacent space (cell spaces Sa to Sc, Si, Sn, Ss, and Su to Sw) is included in the cell spaces Sa to Se, Si, Sj, Sn, So, Ss, St, and Su to Sy that are not the air conditioning target spaces.

After step S3, the process proceeds to step S4 and step S5. Step S4 and step S5 are concurrently executed.

In step S4, the control unit 10 operates as the operating-unit control unit 13. The operating-unit control unit 13 divides the space M where the user requires air conditioning into two blocks. The two blocks are: a boundary side space M1 that defines the boundary between the space M and the space outside thereof (cell spaces Sa to Se, Si, Sj, Sn, So, Ss, St, and Su to Sy); and an inner space M2 surrounded by the boundary side space M1. The operating-unit control unit 13 controls the indoor units 30*k* and 30*l* in the inner space M2 according to settings of the operation mode, set temperature, air volume, direction of air, and the like that were input by the user via the remote controllers 40*a*, 40*b*, . . . , and 40*y*. On the other hand, the operating-unit control unit 13 controls the indoor units 30*f* to 30*h*, 30*m*, 30*p* to 30*r* in the boundary side space M1 such that the settings input by the user via the remote controllers 40*a*, 40*b*, . . . , and 40*y* are performed at a lower performance level. For example, control is performed such that the set temperature is raised by a predetermined amount in the case of the cooling operation mode and is lowered by a predetermined amount in the case of the heating mode, and the air volume is decreased by a predetermine level.

In this way, in this step S4, air in the boundary side space M1 which tends to easily diffuse into a space where the user does not require air conditioning (cell spaces 30*a* to 30*e*, 30*i*, 30*j*, 30*n*, 30*o*, and 30*s* to 30*y*) is conditioned at a lower performance level, and thereby it is possible to achieve energy conservation.

In addition, in step S5, the control unit 10 operates as the adjacent-unit control unit 14. The adjacent-unit control unit 14 causes the adjacent units 30*a* to 30*c*, 30*i*, 30*n*, 30*s*, and 30*u* to 30*w* specified in step S3 to perform a thermo-off operation, i.e., an operation in the air blowing mode where only blowing of air is performed. At this time, the direction of air from the adjacent units 30*a* to 30*c*, 30*i*, 30*n*, 30*s*, and 30*u* to 30*w* is downward or obliquely downward in the direction toward the outside of the adjacent units 30*a* to 30*c*, 30*i*, 30*n*, 30*s*, and 30*u* to 30*w*, or the direction of air is set to a swing mode where the air swings between these directions. Note that a specific angle of the "obliquely downward" direction as referred to herein may be predetermined based on the distances among the indoor units 30*a*, 30*b*, and 30*y*, or may be automatically calculated by referring to the memory unit 20 in which information regarding these distances are stored in advance. Or, the direction of air from the adjacent units may be determined according to the setting of the operating units 30*f* to 30*h*, 30*k* to 30*m*, and 30*p* to 30*r*. For example, if the setting of the operating units 30*f* to 30*h*, 30*k* to 30*m*, and 30*p* to 30*r* is "downward", the direction of air from the adjacent units is adjusted to be more downward. Further, the air volume of the adjacent units may be uniformly set to, for example, "strong" or may be determined according to the setting of the operating units 30*f* to 30*h*, 30*k* to 30*m*, and 30*p* to 30*r*. For example, if the setting of the operating units 30*f* to 30*h*, 30*k* to 30*m*, and 30*p* to 30*r* is "strong," the air volume of the adjacent units may be set to "strong", and if the setting of the operating units 30*f* to 30*h*, 30*k* to 30*m*, and 30*p* to 30*r* is "weak," the air volume of the adjacent units may be set to "weak".

Accordingly, in this step S5, it is possible to inhibit air conditioned by the operating units 30*f* to 30*h*, 30*k* to 30*m*, and 30*p* to 30*r* in the space M where the user requires air conditioning from diffusing from the space M where the user requires air conditioning.

Note that the indoor units 30*d*, 30*e*, 30*j*, 30*o*, 30*t*, 30*x*, and 30*y* that are neither the operating units 30*f* to 30*h*, 30*k* to 30*m*, and 30*p* to 30*r* specified by the operating-unit specifying unit 11 nor the adjacent units 30*a* to 30*c*, 30*i*, 30*n*, 30*s*, and 30*u* to 30*w* specified by the adjacent-unit specifying unit 12 are held in the OFF state unless the operation in the air blowing mode is selected by the user.

Figure 7:
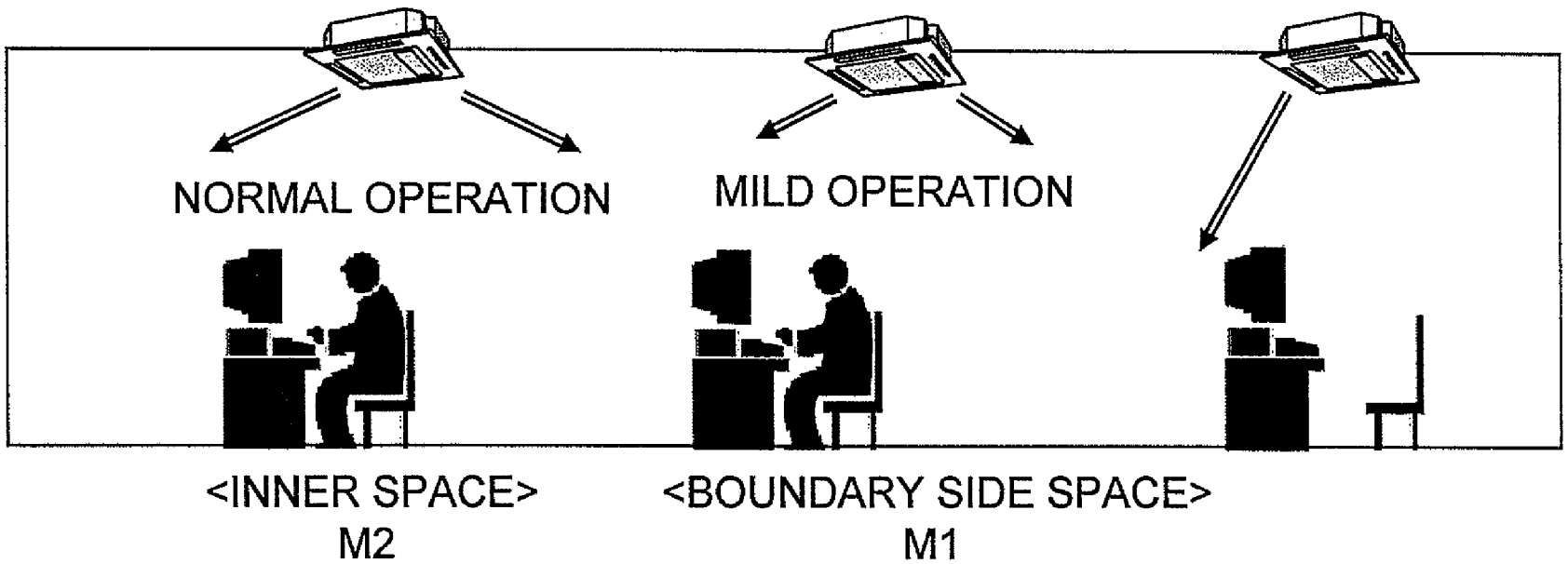
FIG. 7 is a view showing the setting of the indoor space to which air conditioning control according to the first embodiment of the present invention is being applied.

FIG. 7 is a view showing the setting of the indoor space A during execution of step S4 and step S5 in the above described specific example.

Note that when the process proceeds to step S6 after step S2, each of the indoor units 30*a*, 30*b*, . . . , and 30*y* in the indoor space A will be controlled according to the settings of the operation mode, set temperature, air volume, direction of air, and the like that were input by the user via the remote controllers 40*a*, 40*b*, . . . , and 40*y*.

<Characteristics>

In the above embodiment, when the user commands that only some indoor units 30*f* to 30*h*, 30*k* to 30*m*, and 30*p* to 30*r* should perform the air conditioning operation in the single large open indoor space A where the plurality of indoor units 30*a*, 30*b*, . . . , and 30*y* are installed, the indoor units 30*a* to 30*c*, 30*i*, 30*n*, 30*s*, and 30*u* to 30*w* that surround those some indoor units 30*f* to 30*h*, 30*k* to 30*m*, and 30*p* to 30*r* perform the air blowing operation, and thereby the space M that should be air conditioned will be enveloped by an air curtain. Accordingly, conditioned air is inhibited from diff-using from the space M that should be air conditioned, and thereby it is possible to achieve energy conservation.

Alternative Embodiments (1)

In the above embodiment, in step S4 in FIG. 6, the space M where the user requires air conditioning is divided into two blocks (the boundary side space M1 and the inner space M2), and a different type of control is performed for each block; however, such control may be omitted. In other words, the entire space M may be controlled according to the settings that were input by the user via the remote controllers 40*a*, 40*b*, . . . , and 40*y*.

(2)

In the above embodiment, in step S5 in FIG. 6, the adjacent units 30*a* to 30*c*, 30*i*, 30*n*, 30*s*, and 30*u* to 30*w* are controlled to perform the thermo-off operation; however, they may be controlled to perform a mild cooling operation or a mild heating operation. In this case, the mild cooling operation or the mild heating operation of the adjacent units 30*a* to 30*c*, 30*i*, 30*n*, 30*s*, and 30*u* to 30*w* will aid the cooling operation or the heating operation in the space M where the user requires air conditioning.

(3)

In the above embodiment, a location identifying system capable of automatically detecting the location of a living body such as a person or an animal present in the indoor space A may be introduced. For example, as such a location identifying system, infrared sensors may be installed at several appropriate locations in the indoor space A. Or, a living body in the indoor space A may carry a transmitter, and receivers capable of detecting a signal from the transmitter may be installed in several appropriate locations in the indoor space A. Additionally, as a transmitter, a device such as an IC tag may be used. If a transmitter and receivers are introduced as the location identifying system, the control unit 10 and the like will identify the location of the transmitter by triangulation or other methods based on a signal from the transmitter that was received by the receivers. Further, mainly in the case where the indoor space A is an office or the like, an entering/leaving management system introduced as the location identifying system into the indoor space A, or a personal computer used by an employee working in the indoor space A which allows manual input of information indicating the presence or absence of people may be used by interlocking with the air conditioning control device 1.

In this case, information regarding the location of a living body identified by such a location identifying system is sent to the control unit 10 of the air conditioning control device 1. In step S2 in FIG. 6, the operating-unit specifying unit 11 specifies the operating units based on the information regarding the location of the living body identified by the location identifying system in addition to or instead of the operation commands sent from the remote controllers 40*a*, 40*b*, . . . , and 40*y*. Additionally, in this case, the process in FIG. 6 may be executed in the case where the information regarding the location of the living body is sent to the control unit 10 from the location identifying system in addition to or instead of the case where the operation commands input by the user are sent to the control unit 10 from the remote controllers 40*a*, 40*b*, . . . , and 40*y*.

(4)

In the above embodiment, opening and closing of the flaps 31*a* to 31*d* of each of the indoor units 30*a*, 30*b*, . . . , and 30*y* may be independently controllable for each of the flaps 31*a* to 31*d*.

In this case, the thermo-off operation of the adjacent units 30*a* to 30*c*, 30*i*, 30*n*, 30*s*, and 30*u* to 30*w* in step S5 in FIG. 6 may be controlled as described below.

Specifically, among the four flaps 31*a* to 31*d* of each of the adjacent units 30*a* to 30*c*, 30*i*, 30*n*, 30*s*, and 30*u* to 30*w*, the adjacent-unit control unit 14 causes air to be blown out only from the flaps that can direct air to be blown toward the space M for which the operating units 30*f* to 30*h*, 30*k* to 30*m*, and 30*p* to 30*r* are arranged. For example, for each of the adjacent units 30*a* to 30*c*, 30*i*, 30*n*, 30*s*, and 30*u* to 30*w*, the adjacent-unit control unit 14 causes air to be blown only from the flap closer to the space M than the suction port 33 among the four flaps 31*a* to 31*d*, and inhibits air from being blown out from other flaps. Note that in this alternative embodiment, for example, an arrangement information management table 22 shown in FIG. 8, instead of the arrangement information management table 21, is stored in the memory unit 20. Specifically, the arrangement information management table 22 manages information indicating the indoor units 30*a*, 30*b*, . . . , and 30*y* adjacent to each of the flaps 31*a* to 31*d* of each of the indoor units 30*a*, 30*b*, . . . , and 30*y*. Accordingly, the adjacent-unit control unit 14 can specify the flaps that can direct air to be blown toward the space M where the user requires air conditioning by referring to the arrangement information management table 22.

(5)

The above embodiment may be configured such that the user can select an "air curtain mode" in each of the indoor units 30*a*, 30*b*, . . . , and 30*y* via the remote controllers 40*a*, 40*b*, . . . , and 40*y* and the like.

In this case, the control unit 10 of the air conditioning control device 1 executes the following process instead of the process shown in FIG. 6.

Specifically, the control unit 10 causes the indoor units 30*a*, 30*b*, . . . , and 30*y* in which the user selected the "air curtain mode" via the remote controllers 40*a*, 40*b*, . . . , and 40*y* to perform the thermo-off operation, the mild cooling operation, or the mild heating operation, as in step S5 in FIG. 6 or the alternative embodiment (2). At this time, the direction of air from the indoor units 30*a*, 30*b*, . . . , and 30*y* in which the "air curtain mode" is selected is downward or obliquely downward in the direction toward the outside of the indoor units 30*a*, 30*b*, . . . , and 30*y* in which the "air curtain mode" is selected, or the direction of air is set to the swing mode where the air swings between these directions. In addition, as in step S5 in FIG. 6, a specific angle of the "obliquely downward" direction as referred to herein may be predetermined based on the distances among the indoor units 30*a*, 30*b*, . . . , and 30*y*, or may be automatically calculated by referring to the memory unit 20 in which information regarding these distances are stored in advance.

On the other hand, as for the indoor units 30*a*, 30*b*, . . . , and 30*y* in which a mode other than the "air curtain mode" (for example, the cooling operation mode or the heating operation mode) is selected by the user via the remote controllers 40*a*, 40*b*, . . . , and 40*y*, the control unit 10 performs control according to the settings of the operation mode, set temperature, air volume, direction of air, and the like that were input by the user via the remote controllers 40*a*, 40*b*, . . . , and 40*y*.

(6)

In the above embodiment, the following process instead of the process shown in FIG. 6 may be executed in the air conditioning control device 1.

Specifically, each of the indoor units 30*a*, 30*b*, . . . , and 30*y* may be controlled according to an output value of a suction temperature sensor attached near the suction port 33 of each of the indoor units 30*a*, 30*b*, . . . , and 30*y*. The control unit 35 of each of the indoor units 30*a*, 30*b*, . . . , and 30*y* causes the indoor units 30*a*, 30*b*, . . . , and 30*y* to perform the thermo-off operation, the mild cooling operation, or the mild heating operation, as in step S5 or the alternative embodiment (2), when it is determined based on an output value of the suction temperature sensor that cold air or warm air is flowing out from the space M that should be air conditioned. At this time, the direction of air is downward or obliquely downward in the direction toward the outside of the indoor units 30*a*, 30*b*, . . . , and 30*y*, or the direction of air is set to the swing mode where the air swings between these directions. Note that, as in step S5 in FIG. 6, a specific angle of the "obliquely downward" direction as referred to herein may be predetermined based on the distances among the indoor units 30*a*, 30*b*, . . . , and 30*y*, or may be automatically calculated by referring to the memory unit 20 in which information regarding these distances are stored in advance.

In addition, in step S5 of the above embodiment, the settings of the operation mode, set temperature, air volume, direction of air, and the like of the adjacent units 30*a* to 30*c*, 30*i*, 30*n*, 30*s*, and 30*u* to 30*w* may be adjusted according to an output value of the suction temperature sensor attached near the suction port 33 of each of the adjacent units 30*a* to 30*c*, 30*i*, 30*n*, 30*s*, and 30*u* to 30*w*.

(7)

The air conditioning control device 1 may be a central remote controller for the air conditioner including the indoor units 30*a*, 30*b*, . . . , and 30*y*. Consequently, the user can input an operation command to each of the indoor units 30*a*, 30*b*, . . . , and 30*y* via an input unit (not shown) of the air conditioning control device 1. Note that an operation command input via the input unit (not shown) of the air conditioning control device 1 is processed in the same manner as an operation command input via the remote controllers 40*a*, 40*b*, . . . , and 40*y*.

(8)

The above described alternative embodiments (1) to (6) may be combined in any manner.

Second Embodiment

An air conditioning control device 101 according to a second embodiment of the present invention is described below. Note that the constituent elements common to the second embodiment and the first embodiment are denoted by the same reference symbols. The second embodiment is described below focusing on the difference from the first embodiment.

<Installation Environment of Air Conditioning Control Device>

Figure 9:
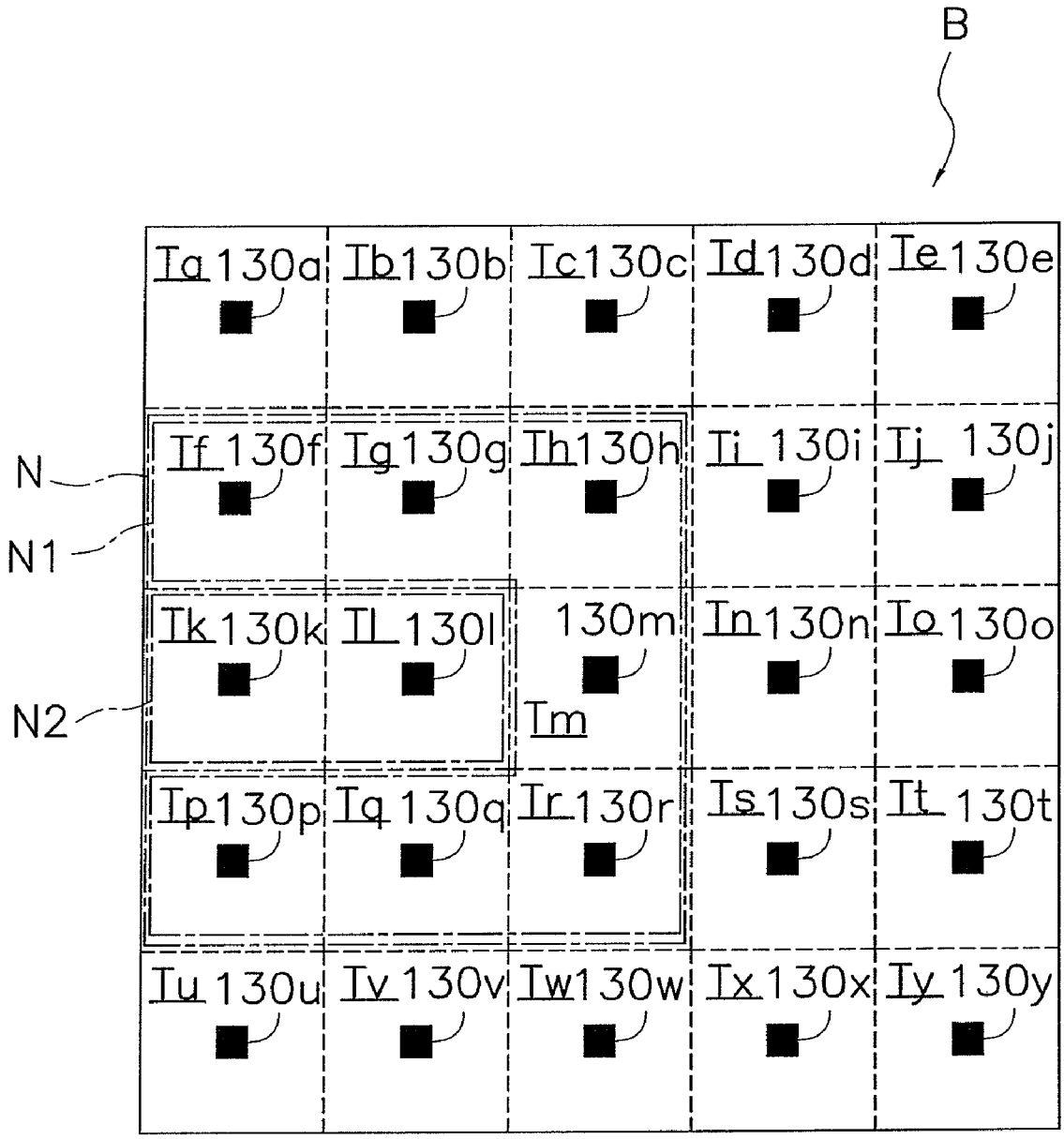
FIG. 9 is a view showing the setting of an indoor space where indoor units of an air conditioner controlled by an air conditioning control device according to a second embodiment of the present invention are installed.

FIG. 9 shows the setting of an indoor space B where indoor units 130*a*, 130*b*, . . . , and 130*y* of an air conditioner controlled by the air conditioning control device 101 are installed. The indoor space B is a single large open space such as an office, restaurant, and the like.

In a ceiling of the indoor space B, the plurality of indoor units 130*a*, 130*b*, . . . , and 130*y* are embedded at appropriate intervals. In FIG. 9, cell spaces Ta, Th, . . . , and Ty partitioned by broken lines are spaces that are virtually divided, and are correspond to respectively for the indoor units 130*a*, 130*b*, . . . , and 130*y*. The cell spaces Ta, Tb, . . . , and Ty include the indoor units 130*a*, 130*b*, . . . , and 130*y*, respectively. In addition, the cell spaces Ta, Tb, . . . , and Ty are the target spaces to be air conditioned not only by the indoor units 130*a*, 130*b*, . . . , and 130*y* respectively included in those cell spaces Ta, Tb, . . . , and Ty but also by the indoor units 130*a*, 130*b*, . . . , and 130*y* included in the surrounding spaces Ta, Tb, . . . , and Ty. In other words, for example, the space to be targeted by the air conditioning operation of the air conditioning unit 130*g* is not only the cell space Tg but it also includes the cell spaces Ta to Tc, Tf, Th, and Tk to Tm surrounding the cell space Tg.

<Configuration of the Air Conditioning Control Device>

Figure 10:
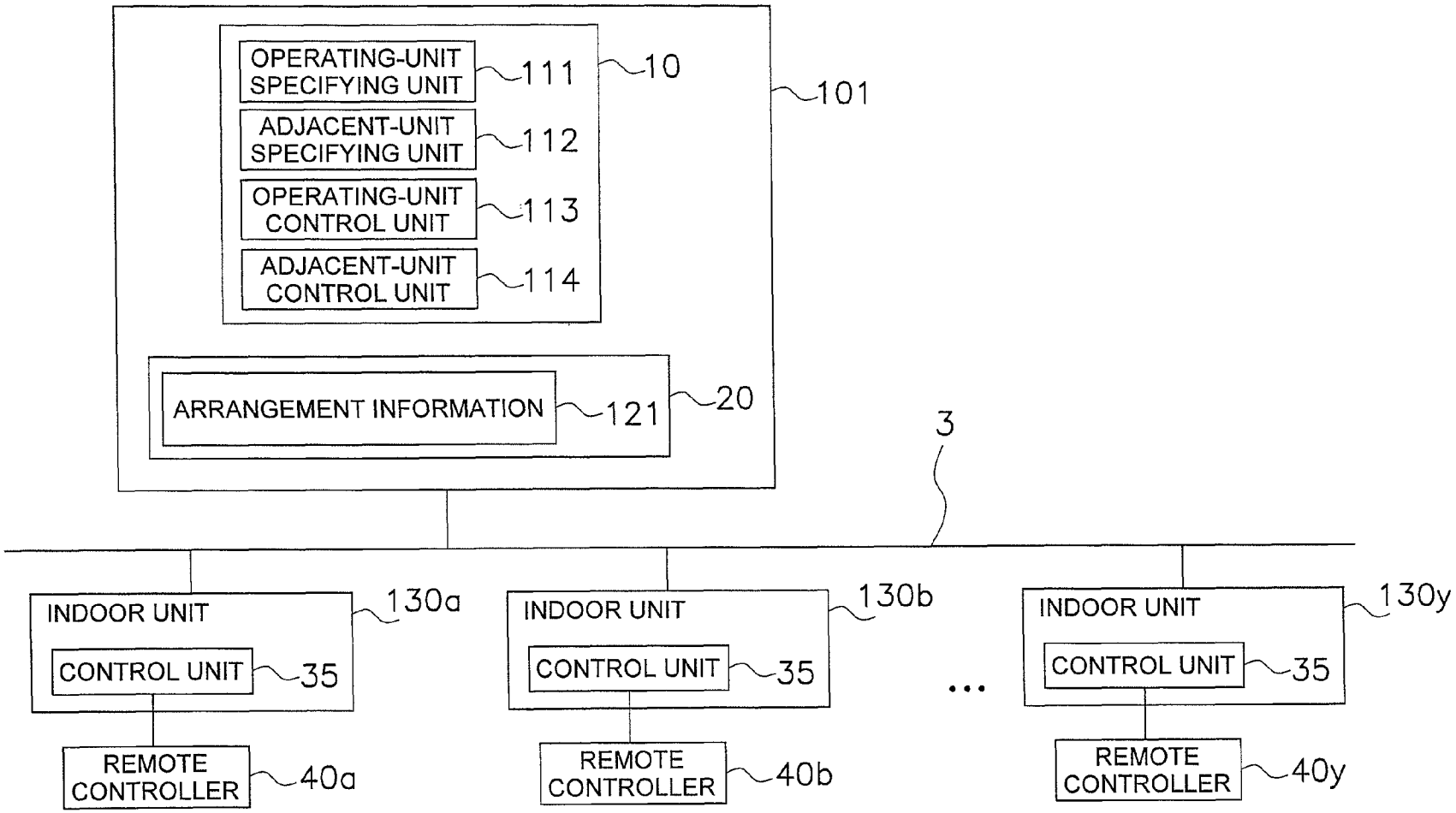
FIG. 10 is a block diagram showing a configuration of the air conditioning control device according to the second embodiment of the present invention.

FIG. 10 is a block diagram showing the configuration of the air conditioning control device 101. The air conditioning control device 101 has the control unit 10 and the memory unit 20. The air conditioning control device 101 is connected to the control unit 35 of each of the indoor units 130*a*, 130*b*, . . . , and 130*y* via the communication network 3, and is capable of controlling the operation of each portion of each of the indoor units 130*a*, 130*b*, . . . , and 130*y* via the control unit 35.

By reading out and executing a control program stored in the memory unit 20, the control unit 10 operates as an operating-unit specifying unit 111, an adjacent-unit specifying unit 112, an operating-unit control unit 113, an adjacent-unit control unit 114 and the like. Details of the operation of each of these units 111 to 114 are described later.

The memory unit 20 stores arrangement information 121 that organizes information regarding the arrangement of the indoor units 130*a*, 130*b*, . . . , and 130*y* in the indoor space B. The arrangement information 121 is, for example, map information that mapped inside the indoor space B and has information that indicates the positional relationship of each of the indoor units 130*a*, 130*b*, . . . , and 130*y*.

<Configuration of Air Conditioner>

Figure 11:
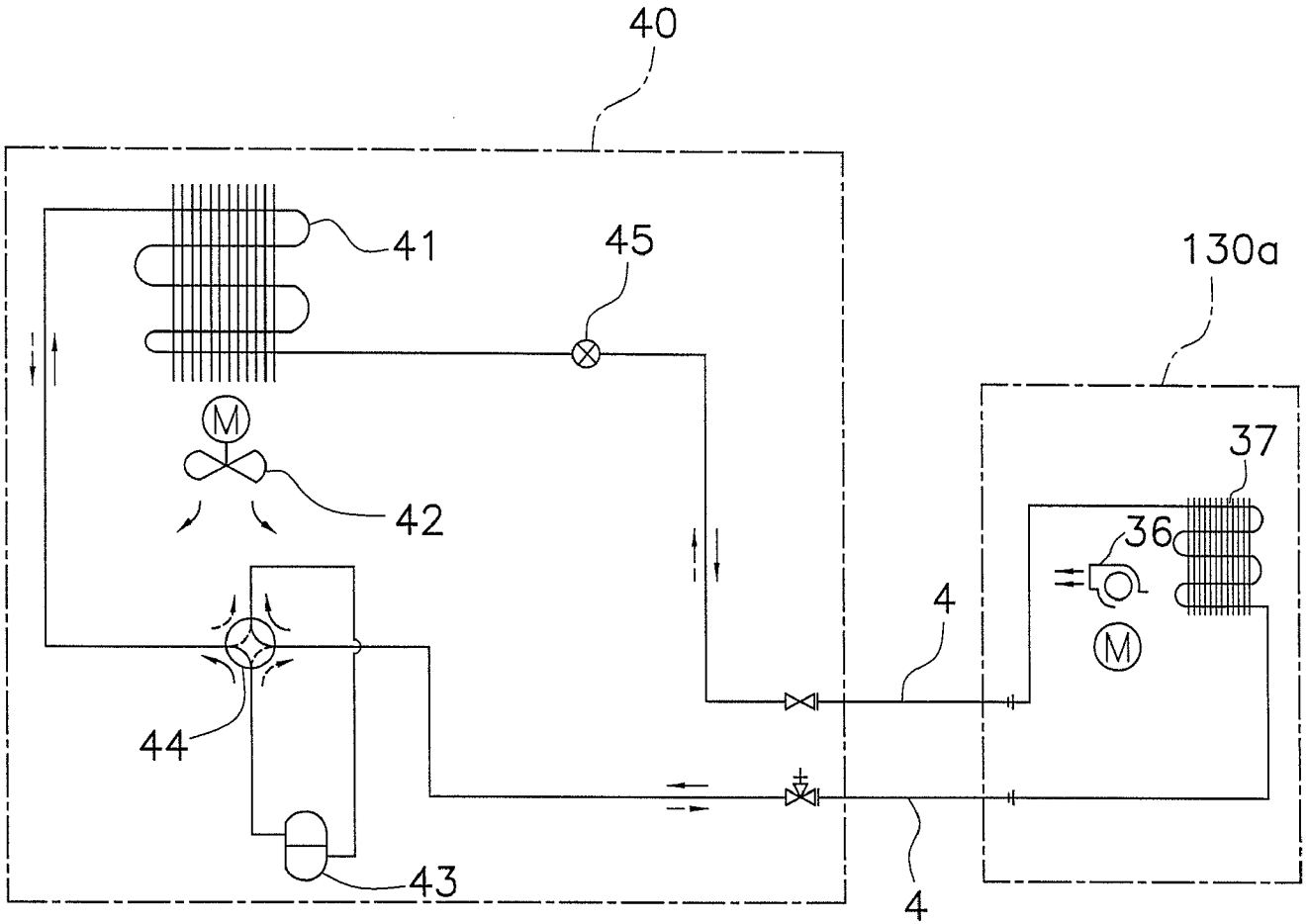
FIG. 11 is a view showing a configuration of the air conditioner according to the second embodiment of the present invention.
Figure 12:
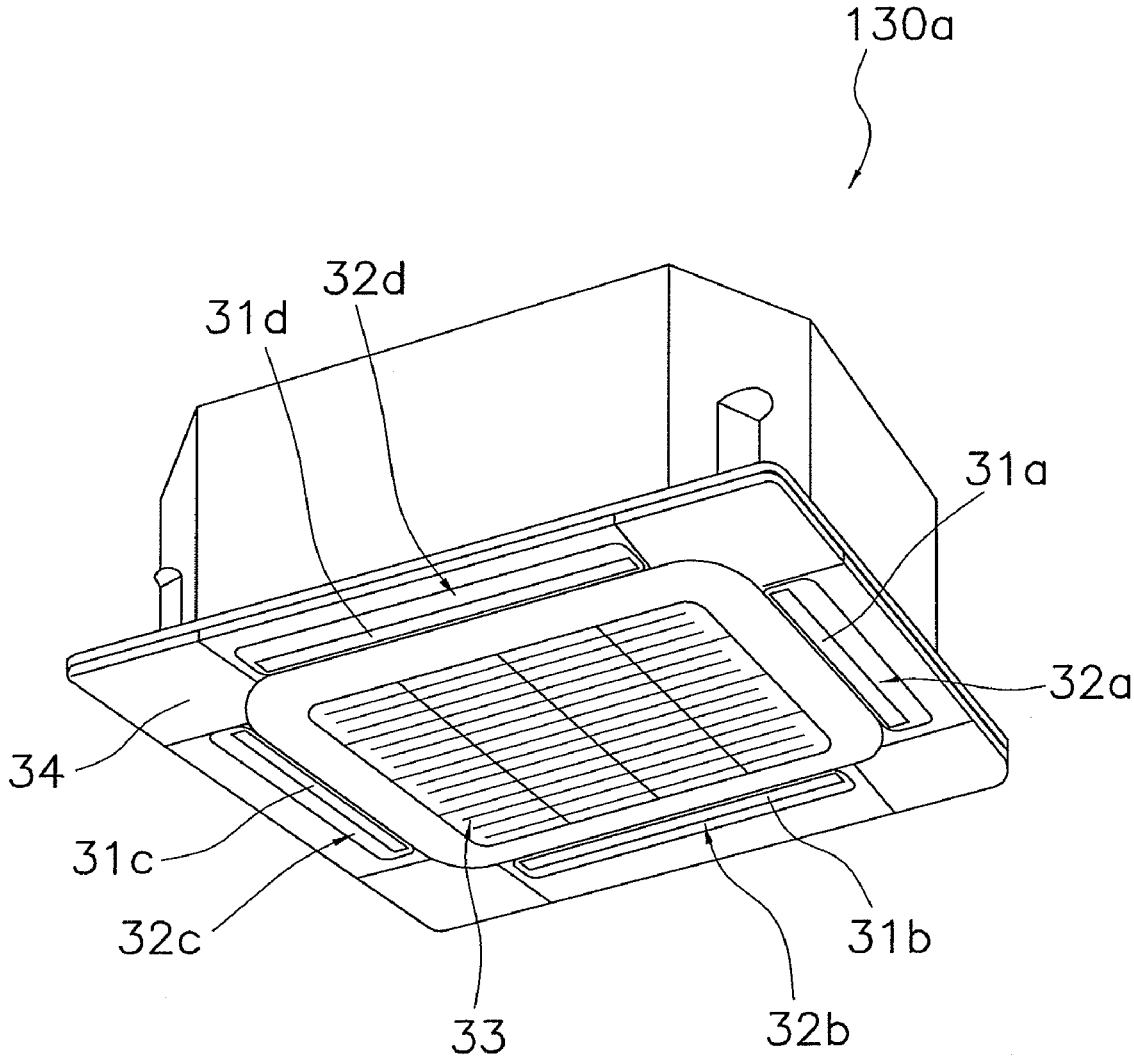
FIG. 12 is an external view of the indoor unit according to the second embodiment of the present invention.

As shown in FIG. 11 and FIG. 12, the indoor unit 130*a* has the same configuration as the indoor unit 30*a* according to the first embodiment. In addition, the indoor units 130*b*, . . . , 130*y* also have the same configuration as the indoor units 30*b*, . . . , 30*y* according to the first embodiment.

<Operation of Air Conditioning Control Device>

Figure 13:
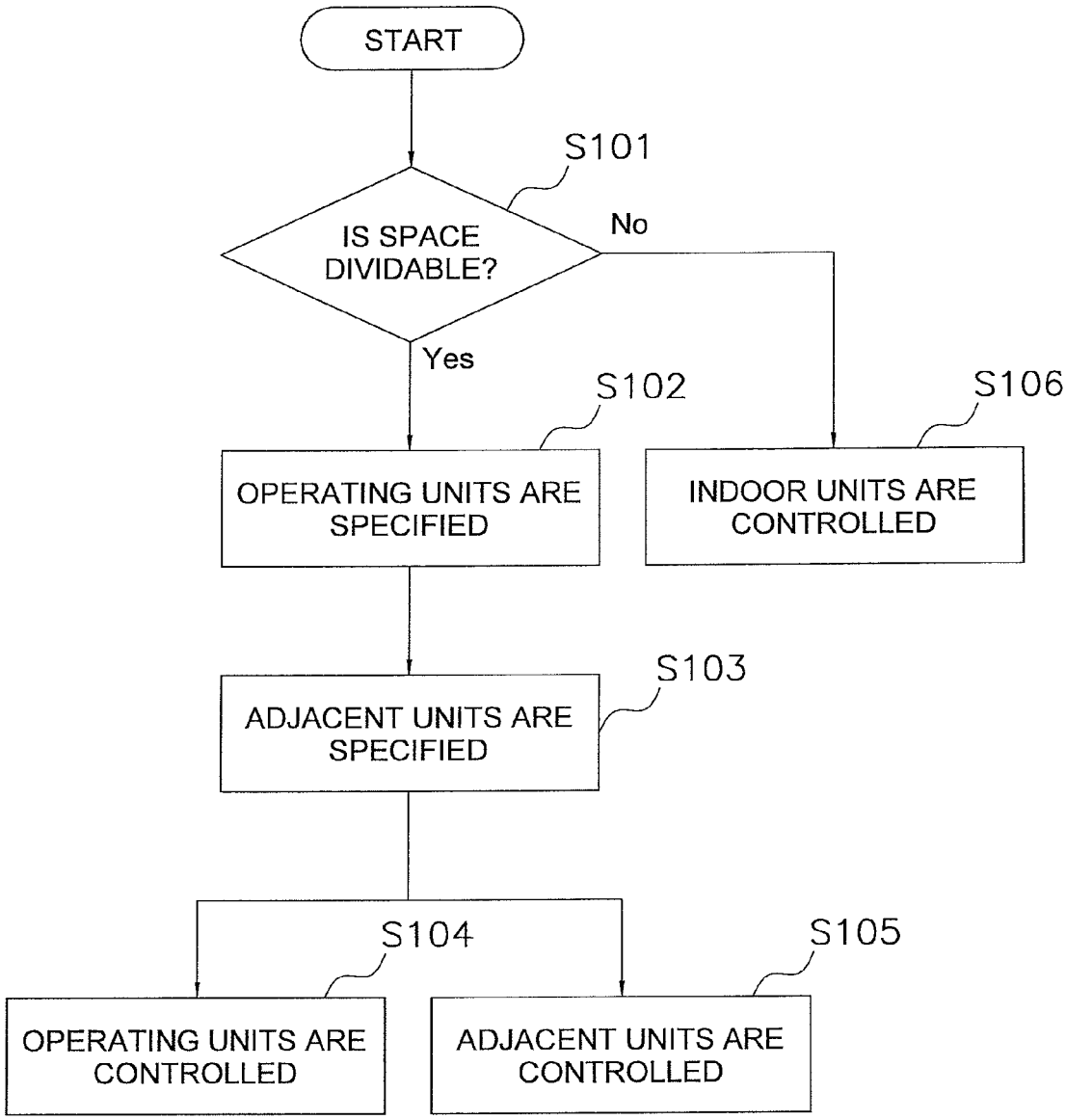
FIG. 13 is a flowchart showing the flow of the process in which the air conditioning control device according to the second embodiment of the present invention controls the indoor units.

FIG. 13 is a flowchart showing the flow of the process in which the air conditioning control device 101 controls the indoor units 130*a*, 130*b*, . . . , and 130*y* of the air conditioner. This process is started when the user started or stopped any type of operation of the indoor units 130*a*, 130*b*, . . . , and 130*y* via the remote controllers 40*a*, 40*b*, . . . , and 40*y* (note that the operation in the air blowing mode where only blowing of air is performed is excluded, and the same applies throughout to the description of the second embodiment unless otherwise explicitly stated). The operation commands input into the remote controllers 40*a*, 40*b*, . . . , and 40*y* by the user are sent to the control unit 10 of the air conditioning control device 101 via the control unit 35 of the indoor units 130*a*, 130*b*, . . . , and 130*y*, respectively, and the communication network 3.

The process shown in FIG. 13 is described below by taking, as a specific example, the case in which the user requires air conditioning only in a space N (see FIG. 9) constituted by the cell spaces Tf to Th, Tk to Tm, and Tp to Tr within the indoor space B. In this specific example, the user selects the operation of the indoor units 130*f* to 130*h*, 130*k* to 130*m*, and 130*p* to 130*r* installed in the space N, among all the indoor units 130*a*, 130*b*, . . . , and 130*y* installed in the indoor space B, via the remote controllers 40*a*, 40*b*, . . . , and 40*y*. In other words, the space N is an air conditioning target space where the user requires air conditioning. For example, the space N is an occupied space where the user is present, and the cell spaces Ta to Te, Ti, Tj, Tn, To, Ts, Tt, and Tu to Ty that are not included in the space N are vacant spaces where the user is not present.

In step S101, based on the operation commands sent from the remote controllers 40*a*, 40*b*, . . . , and 40*y*, the control unit 10 specifies the indoor units 130*f* to 130*h*, 130*k* to 130*m*, and 130*p* to 130*r* being currently selected by the user to operate, among all the indoor units 130*a*, 130*b*, . . . , and 130*y*. Then, the control unit 10 refers to the arrangement information 121 stored in the memory unit 20 and specifies the space N for which the indoor units 130*f* to 130*h*, 130*k* to 130*m*, 130*p* to 130*r* that the user has selected to operate are arranged. Subsequently, the control unit 10 attempts to divide the space N where the user requires air conditioning into two blocks. The two blocks are: a boundary side space N1 that defines the boundary between the space N and the space outside thereof (cell spaces Ta to Te, Ti, Tj, Tn, To, Ts, Tt, and Tu to Ty); and an inner space N2 surrounded by the boundary side space N1. Then, when the control unit 10 succeeded in dividing the space N into the two blocks, in other words, when both the boundary side space N1 and the inner space N2 are present concurrently, the process proceeds to step S102, otherwise to step S106. In the case of the above described specific example, the process proceeds to step S102.

Next, in step S102, the control unit 10 operates as the operating-unit specifying unit 111. The operating-unit specifying unit 111 refers to the arrangement information 121 stored in the memory unit 20 and specifies the indoor units 130*k* and 130*l* (hereinafter referred to as the operating units) in the inner space N2 derived in step S101.

In step S103, the control unit 10 operates as the adjacent-unit specifying unit 112. The adjacent-unit specifying unit 112 refers to the arrangement information 121 stored in the memory unit 20 and specifies the indoor units 130*f* to 130*h*, 130*m*, and 130*p* to 130*r* (hereinafter referred to as the adjacent units) in the boundary side space N1 derived in step S101. Note that, because the boundary side space N1 and the inner space N2 are adjacently arranged, the adjacent units 130*f* to 130*h*, 130*m*, and 130*p* to 130*r* and the operating units 130*k*, and 130*l* are also adjacently arranged.

After step S103, the process proceeds to step S104 and step S105. Step S104 and step S105 are concurrently executed.

In step S104, the control unit 10 operates as the operating-unit control unit 113. The operating-unit control unit 113 controls the operating units 130*k* and 130*l* according to the settings of the operation mode, set temperature, air volume, direction of air, and the like that are input by the user via the remote controllers 40*a*, 40*b*, . . . , and 40*y*.

In addition, in step S105, the control unit 10 operates as the adjacent-unit control unit 114. The adjacent-unit control unit 114 causes the adjacent units 130*f* to 130*h*, 130*m*, and 130*p* to 130*r* specified in step S103 to perform the thermo-off operation, i.e., an operation in the air blowing mode where only blowing of air is performed. At this time, the direction of air from the adjacent units 130*f* to 130*h*, 130*m*, and 130*p* to 130*r* is downward or obliquely downward in the direction toward the outside, or the direction of air is set to a swing mode where the air swings between these directions. Note that a specific angle of the "obliquely downward" direction as referred to herein may be predetermined based on the distances among the indoor units 130*a*, 130*b*, . . . , and 130*y*, or may be automatically calculated by referring to the memory unit 20 in which information regarding these distances are stored in advance. Or, the direction of air from the adjacent units may be determined according to the setting of the operating units 130*k* and 130*l*. For example, if the setting of the operating units 130*k* and 130*l* is "downward", the direction of air from the adjacent units is adjusted to be more downward. Further, the air volume of the adjacent units may be uniformly set to, for example, "strong" or may be determined according to the setting of the operating units 130*k* and 130*l*. For example, if the setting of the operating units 130*k* and 130*l* is "strong," the air volume of the adjacent units may be set to "strong", and if the setting of the operating units 130*k* and 130*l* is "weak," the air volume of the adjacent units may be set to "weak".

Accordingly, in this step S105, it is possible to inhibit air conditioned by the operating units 130*k* and 130*l* in the space N where the user requires air conditioning from diffusing from the space N where the user requires air conditioning.

Note that the indoor units 130*a* to 130*e*, 130*i*, 130*j*, 130*n*, 130*o*, 130*s*, 130*t*, and 130*u* to 130*y* that are neither the operating units 130*k* and 130*l* specified by the operating-unit specifying unit 111 nor the adjacent units 130*f* to 130*h*, 130*m*, and 130*p* to 130*r* specified by the adjacent-unit specifying unit 112 are held in the OFF state unless the operation in the air blowing mode is selected by the user.

Figure 14:
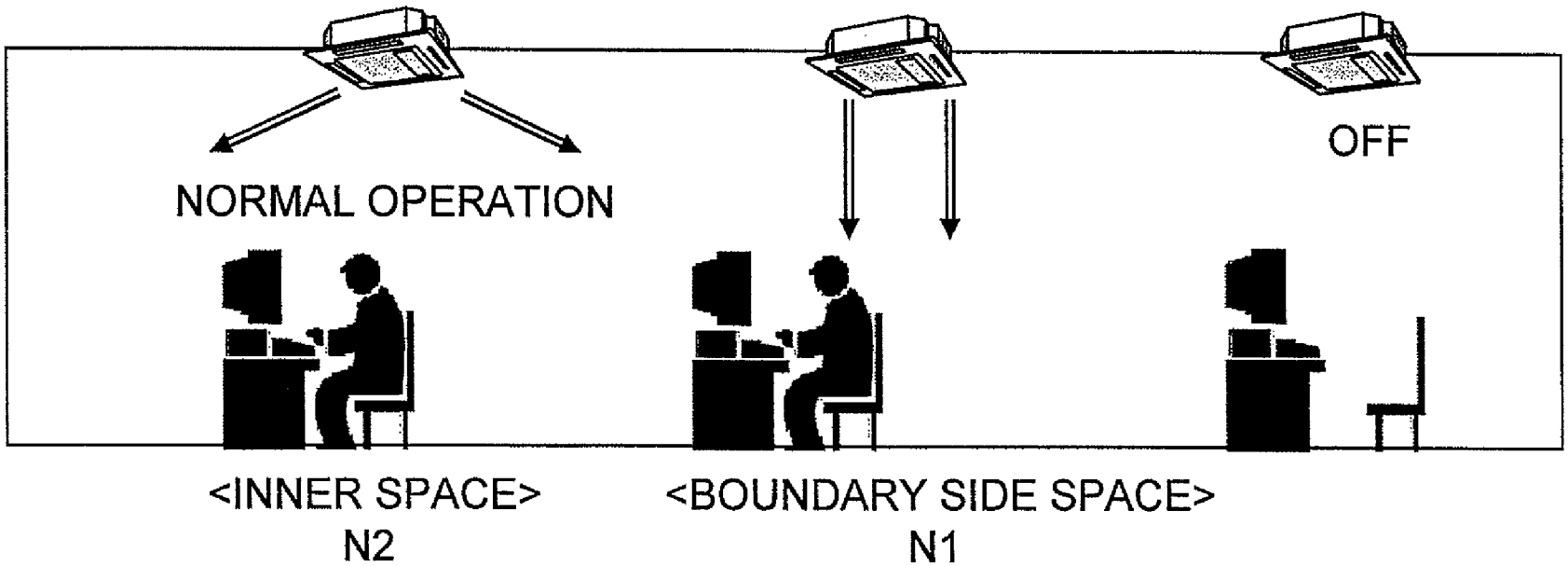
FIG. 14 is a view showing the setting of the indoor space to which air conditioning control according to the second embodiment of the present invention is being applied.

FIG. 14 is a view showing the setting of the indoor space B during execution of step S104 and step S105 in the above described specific example.

Note that when the process proceeds to step S106 after step S101, each of the indoor units 130*a*, 130*b*, . . . , and 130*y* in the indoor space B will be controlled according to the settings of the operation mode, set temperature, air volume, direction of air, and the like that were input by the user via the remote controllers 40*a*, 40*b*, . . . , and 40*y*.

<Characteristics>

In the above embodiment, when the user issues a command that only some indoor units 130*f* to 130*h*, 130*k* to 130*m*, and 130*p* to 130*r* should perform the air conditioning operation in the single large open indoor space B where the plurality of indoor units 130*a*, 130*b*, . . . , and 130*y* are installed, the indoor units 130*f* to 130*h*, 130*m*, and 130*p* to 130*r* in the boundary side space N1 perform the air blowing operation, and thereby the space N that should be air conditioned will be enveloped by an air curtain. The boundary side space N1 is a space that defines the boundary between the space N and the space outside thereof (cell spaces Ta to Te, Ti, Tj, Tn, To, Ts, Tt, and Tu to Ty) in the space N side. Accordingly, the conditioned air is inhibited from diffusing from the space N that should be air conditioned, and thereby it is possible to achieve energy conservation.

Alternative Embodiments (1)

In the above embodiment, in step S105 in FIG. 13, the adjacent units 130*f* to 130*h*, 130*m*, and 130*p* to 130*r* are controlled to perform the thermo-off operation; however, they may be controlled to perform the mild cooling operation or the mild heating operation. In this case, the mild cooling operation or the mild heating operation of the adjacent units 130*f* to 130*h*, 130*m*, and 130*p* to 130*r* will aid the cooling operation or the heating operation in the space N where the user requires air conditioning.

(2)

In the above embodiment, a location identifying system capable of automatically detecting the location of a living body such as a person or an animal present in the indoor space B may be introduced. For example, as such a location identifying system, infrared sensors may be installed at several appropriate locations in the indoor space B. Or, a living body in the indoor space B may carry a transmitter, and receivers capable of detecting a signal from the transmitter may be installed in several appropriate locations in the indoor space B. Additionally, as a transmitter, a device such as an IC tag may be used. If a transmitter and receivers are introduced as the location identifying system, the control unit 10 and the like will identify the location of the transmitter by triangulation or other methods based on a signal from the transmitter that was received by the receivers. Further, mainly in the case where the indoor space B is an office or the like, an entering/leaving management system introduced as the location identifying system into the indoor space B, or a personal computer used by an employee working in the indoor space B which allows manual input of information indicating the presence or absence of people may be used by interlocking with the air conditioning control device 101.

In this case, information regarding the location of a living body identified by such a location identifying system is sent to the control unit 10 of the air conditioning control device 101. Then, in step S102 in FIG. 13, the operating-unit specifying unit 111 specifies the operating units and adjacent units based on the information regarding the location of the living body identified by the location identifying system in addition to or instead of the operation commands sent from the remote controllers 40*a*, 40*b*, . . . , and 40*y*. Additionally, in this case, the process in FIG. 13 may be executed in the case where the information regarding the location of the living body is sent to the control unit 10 from the location identifying system in addition to or instead of the case where the operation commands input by the user are sent to the control unit 10 from the remote controllers 40*a*, 40*b*, . . . , and 40*y*.

(3)

In the above embodiment, opening and closing of the flaps 31*a* to 31*d* of each of the indoor units 130*a*, 130*b*, . . . , and 130*y* may be independently controllable for each of the flaps 31*a* to 31*d*.

In this case, the thermo-off operation of the adjacent units 130*f* to 130*h*, 130*m*, and 130*p* to 130*r* in step S105 in FIG. 13 may be controlled as described below.

Figure 15:
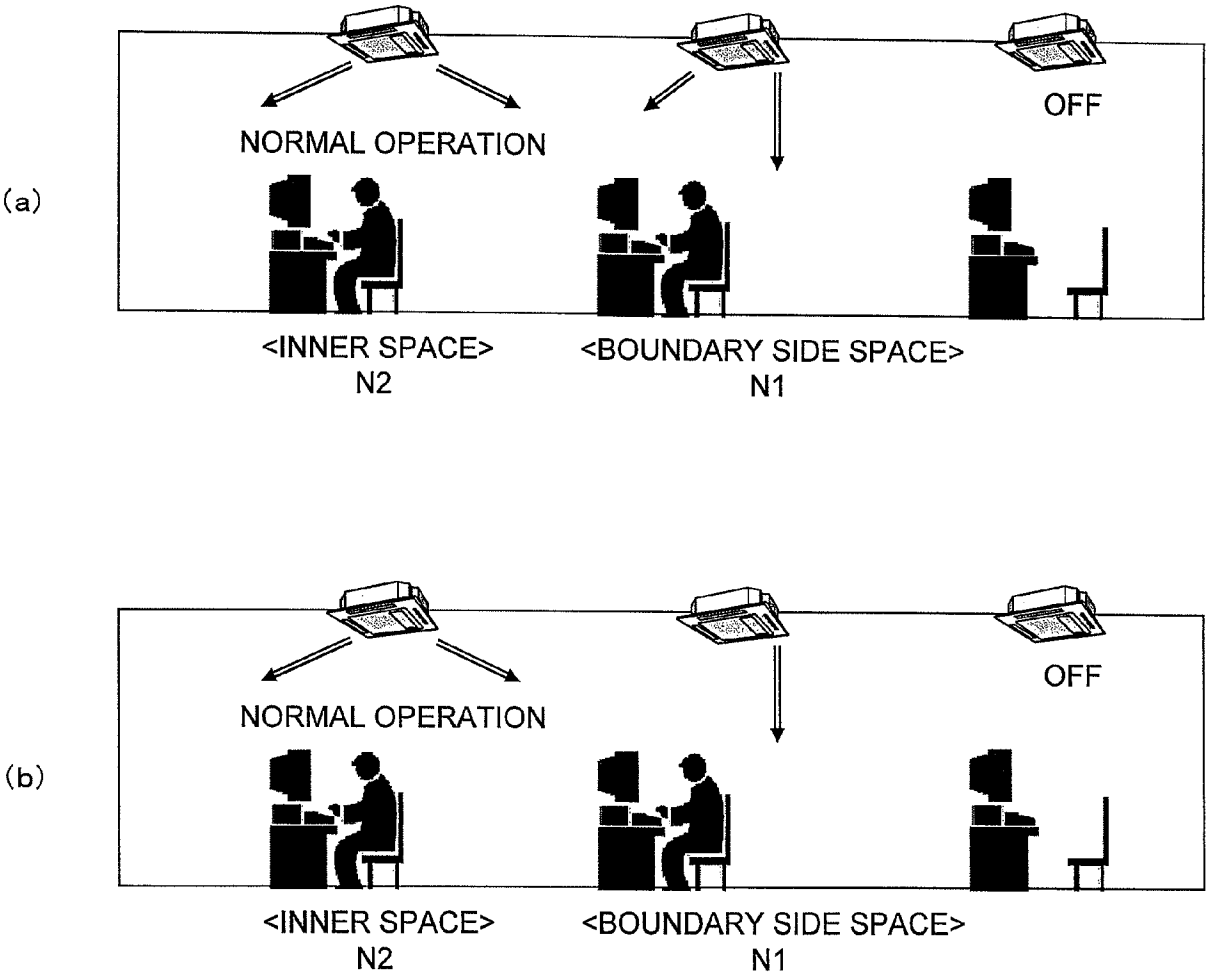
FIG. 15(*a*) is a view showing the setting of the indoor space to which air conditioning control according to an alternative embodiment (3) of the second embodiment of the present invention is being applied.

Specifically, the adjacent-unit control unit 114 causes air to be blown out in different directions from the four flaps 31*a* to 31*d* of each of the adjacent units 130*f* to 130*h*, 130*m*, and 130*p* to 130*r*. Consequently, for example, air is blown out downward from each flap farther from the inner space N2 than the suction port 33 (i.e., flaps closer to the cell spaces Ta to Te, Ti, Tj, Tn, To, Ts, Tt, and Tu to Ty that are not the air conditioning target spaces), and air is blown out obliquely downward from each flap closer to the inner space N2 than the suction port 33 (i.e, flaps farther from the cell spaces Ta to Te, Ti, Tj, Tn, To, Ts, Tt, and Tu to Ty that are not the air conditioning target spaces) (see FIG. 15(*a*)). Or, among the four flaps 31*a* to 31*d* of each of the adjacent units 130*f* to 130*h*, 130*m*, and 130*p* to 130*r*, air is blown out only from the flap farther from the inner space N2 than the suction port 33 (i.e., flaps closer to the cell spaces Ta to Te, Ti, Tj, Tn, To, Ts, Tt, and Tu to Ty that are not the air conditioning target spaces) (see FIG. 15(*b*)). At this time, air is not blown out from each flap closer to the inner space N2 than the suction port 33 (i.e., flaps farther from the cell spaces Ta to Te, Ti, Tj, Tn, To, Ts, Tt, and Tu to Ty that are not the air conditioning target spaces).

Note that in this alternative embodiment, for example, the arrangement information 121 stored in the memory unit 20 has information indicating the position of each of the flaps 31*a* to 31*d* of each of the indoor units 130*a*, 130*b*, . . . , and 130*y*. Accordingly, the adjacent-unit control unit 114 can refer to the arrangement information 121 and specify the flap closer to or farther from the inner space N2 than the suction port 33.

(4)

In step S105 of the above embodiment, the settings of the operation mode, set temperature, air volume, direction of air, and the like of the adjacent units 130*f* to 130*h*, 130*m*, and 130*p* to 130*r* may be adjusted according to an output value of a suction temperature sensor attached near the suction port 33 of each of the adjacent units 130*f* to 130*h*, 130*m*, and 130*p* to 130*r*.

(5)

Figure 16:
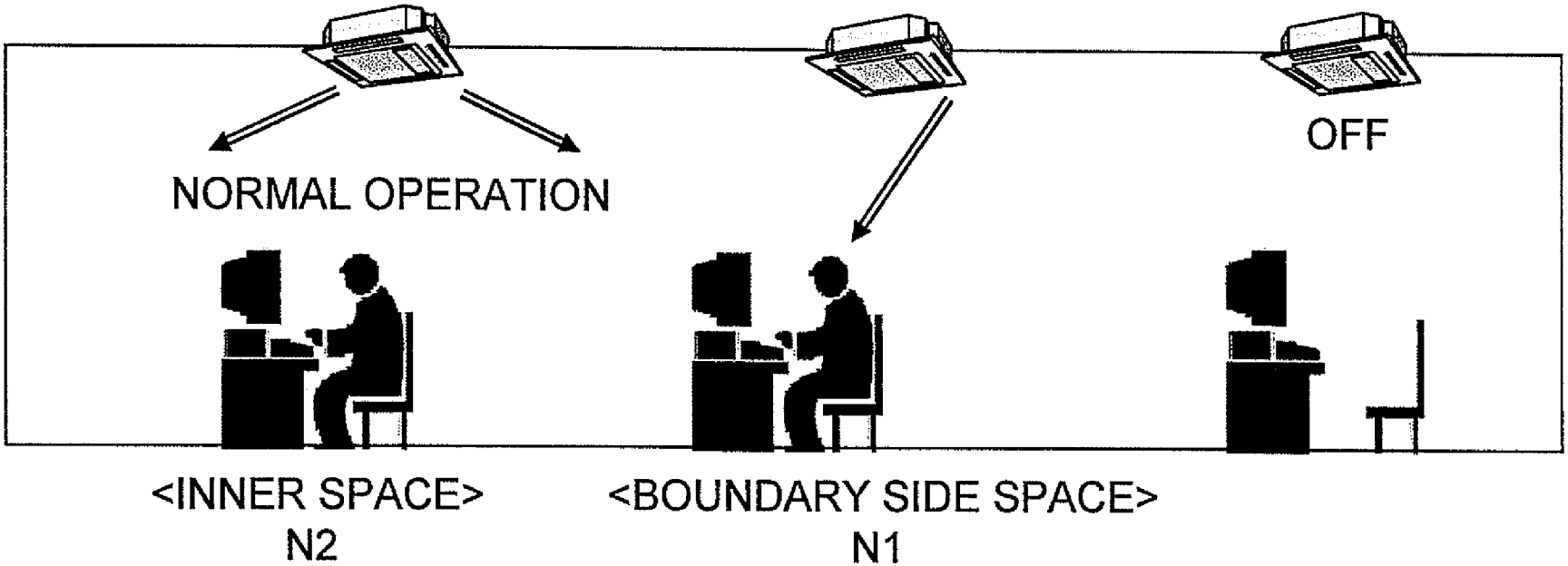
FIG. 16 is a view showing the setting of the indoor space to which air conditioning control according to an alternative embodiment (5) of the second embodiment of the present invention is being applied.

In the above embodiment, when the cooling mode is selected by the user, the adjacent-unit control unit 114 may perform control such that the direction of air blowing from each of the adjacent units 130*f* to 130*h*, 130*m*, and 130*p* to 130*r* is directed toward a living body such as a person or an animal present in the boundary side space N1 (see FIG. 16). Note that, in the example shown in FIG. 16, opening and closing of each of the flaps 31*a* to 31*d* of each of the indoor units 130*a*, 130*b*, . . . , and 130*y* are independently controllable, as in the alternative embodiment (3). In this case, a location identifying system capable of automatically detecting the location of a living body present in the indoor space B may be connected to the air conditioning control device 101. Such a location identifying system includes the examples described in the alternative embodiment (2). Information regarding the location of a living body identified by such a location identifying system is sent to the control unit 10 of the air conditioning control device 101. Additionally, in step S105 in FIG. 13, the adjacent-unit control unit 114 controls the direction of air from each of the adjacent units 130*f* to 130*h*, 130*m*, and 130*p* to 130*r* based on the information regarding the location of the living body identified by the location identifying system.

In the above embodiment, because the adjacent units 130*f* to 130*h*, 130*m*, and 130*p* to 130*r* do not perform the operation as selected by the user, there is a risk that the temperature in the boundary side space N1 for which the adjacent units 130*f* to 130*h*, 130*m*, and 130*p* to 130*r* are arranged may become high, thus impairing comfort. Therefore, in this alternative embodiment, when the operating units 130*k* and 130*l* perform the cooling operation, each of the adjacent units 130*f* to 130*h*, 130*m*, and 130*p* to 130*r* is caused to blow out air toward a living body present in the vicinity of each of the adjacent units 130*f* to 130*h*, 130*m*, and 130*p* to 130*r*, respectively. In other words, in this alternative embodiment, the adjacent units 130*f* to 130*h*, 130*m*, and 130*p* to 130*r* play a role as a fan. Thereby, an air flow in the boundary side space N1 is facilitated, and a difference between the sensible temperature as felt by a living body in the boundary side space N1 and the sensible temperature as felt by a living body in the inner space N2 is reduced, and the above described problem is eliminated.

In addition, in this alternative embodiment, a temperature difference between the boundary side space N1 where the adjacent units 130*f* to 130*h*, 130*m*, and 130*p* to 130*r* are installed and the cell spaces Ta to Te, Ti, Tj, Tn, To, Ts, Tt, and Tu to Ty that are not the air conditioning target spaces does not become too large, thus inhibiting cold air from diffusing from the space N.

Further, a difference between the sensible temperature as felt by a living body in the boundary side space N1 (cell spaces Tf to Th, Tm, and Tp to Tr) and the sensible temperature as felt by a living body in the inner space N2 (cell spaces Tk and Tl) may be converted into an index and measured, and the direction of air from each of the adjacent units 130*f* to 130*h*, 130*m*, and 130*p* to 130*r* may be controlled by the adjacent-unit control unit 114 such that the difference with respect to the sensible temperature is equal to or lower than a predetermined value. In this case, when the difference with respect to the sensible temperature cannot be maintained equal to or lower than a predetermined value, control may be performed so as to increase the performance levels of the operating units 130*k* and 130*l* or the performance levels of the adjacent units 130*f* to 130*h*, 130*m*, and 130*p* to 130*r*, or the performance levels of both these operating units and adjacent units. Note that the difference with respect to the sensible temperature can be converted into an index based on an output value of the suction temperature sensor attached near the suction port 33 of each of the adjacent units 130*f* to 130*h*, 130*m*, and 130*p* to 130*r* and each of the operating units 130*k* and 130*l* as well as information regarding preference of the user for the draft feeling and the like. In addition, instead of the difference with respect to the sensible temperature, comfort in the boundary side space N1 (cell spaces Tf to Th, Tm, and Tp to Tr) may be converted into an index and measured. Note that the comfort can be converted into an index based on an output value of the suction temperature sensor attached near the suction port 33 of each of the adjacent units 130*f* to 130*h*, 130*m*, and 130*p* to 130*r* as well as information regarding preference of the user for the draft feeling and the like.

(6)

In the above embodiment, when the cooling mode is selected by the user, the adjacent-unit control unit 114 may perform control such that the air volume of each of the adjacent units 130*f* to 130*h*, 130*m*, and 130*p* to 130*r* becomes greater than a set value that the user selected for each of the adjacent units 130*f* to 130*h*, 130*m*, and 130*p* to 130*r*. Or, control may be performed such that the air volume of each of the adjacent units 130*f* to 130*h*, 130*m*, and 130*p* to 130*r* becomes greater than a set value selected for each of the operating units 130*k* and 130*l* by a predetermined level. Or, control may be performed such that the air volume of each of the adjacent units 130*f* to 130*h*, 130*m*, and 130*p* to 130*r* is set to a maximum air volume.

In the above embodiment, because the adjacent units 130*f* to 130*h*, 130*m*, and 130*p* to 130*r* do not perform the operation as selected by the user, there is a risk that the temperature in the boundary side space N1 for which the adjacent units 130*f* to 130*h*, 130*m*, and 130*p* to 130*r* are arranged may become high, thus impairing comfort. Therefore, in this alternative embodiment, when the operating units 130*k* and 130*l* perform the cooling operation, the air volume of each of the adjacent units 130*f* to 130*h*, 130*m*, and 130*p* to 130*r* is increased. In other words, in this alternative embodiment, an air flow in the boundary side space N1 is facilitated, and a difference between the sensible temperature as felt by a living body in the boundary side space N1 and the sensible temperature as felt by a living body in the inner space N2 is reduced, and the above described problem is eliminated.

In addition, in this alternative embodiment, a temperature difference between the boundary side space N1 where the adjacent units 130*f* to 130*h*, 130*m*, and 130*p* to 130*r* are installed and the cell spaces Ta to Te, Ti, Tj, Tn, To, Ts, Tt, and Tu to Ty that are not the air conditioning target spaces does not become too large, thus inhibiting cold air from diffusing from the space N.

Further, a difference between the sensible temperature as felt by a living body in the boundary side space N1 (cell spaces Tf to Th, Tm, and Tp to Tr) and the sensible temperature as felt by a living body in the inner space N2 (cell spaces Tk and Ti) may be converted into an index and measured, and the air volume of each of the adjacent units 130*f* to 130*h*, 130*m*, and 130*p* to 130*r* may be controlled by the adjacent-unit control unit 114 such that the difference with respect to the sensible temperature is equal to or lower than a predetermined value. In this case, when the difference with respect to the sensible temperature cannot be maintained equal to or lower than a predetermined value, control may be performed so as to increase the performance levels of the operating units 130*k* and 130*l* or the performance levels of the adjacent units 130*f* to 130*h*, 130*m*, and 130*p* to 130*r*, or the performance levels of both these operating units and adjacent units. Note that the difference with respect to the sensible temperature can be converted into an index based on an output value of the suction temperature sensor attached near the suction port 33 of each of the adjacent units 130*f* to 130*h*, 130*m*, and 130*p* to 130*r* and each of the operating units 130*k* and 130*l* as well as information regarding preference of the user for the draft feeling and the like. In addition, instead of the difference with respect to the sensible temperature, comfort in the boundary side space N1 (cell spaces Tf to Th, Tm, and Tp to Tr) may be converted into an index and measured. Note that the comfort can be converted into an index based on an output value of the suction temperature sensor attached near the suction port 33 of each of the adjacent units 130*f* to 130*h*, 130*m*, and 130*p* to 130*r* as well as information regarding preference of the user for the draft feeling and the like.

(7)

Figure 17:
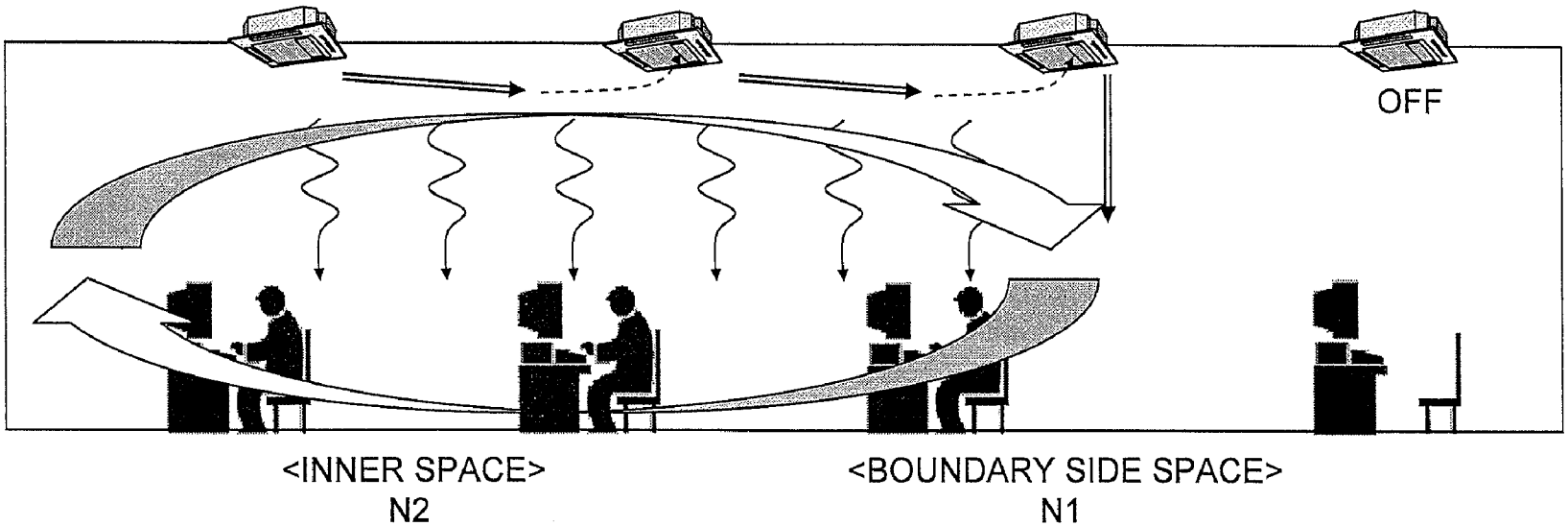
FIG. 17 is a view showing the setting of the indoor space to which air conditioning control according to an alternative embodiment (7) of the second embodiment of the present invention is being applied.

In the above embodiment, when the cooling mode is selected by the user, the operating-unit control unit 113 may perform control such that the direction of air blowing from each of the operating units 130*k* and 130*l* is directed toward the adjacent units 130*f* to 130*h*, 130*m*, and 130*p* to 130*r* (see FIG. 17). In this case, the direction of air from each of the operating units 130*k* and 130*l* is substantially horizontal, and an air flow is formed near the ceiling of the space N which moves along the ceiling in a hovering manner. Accordingly, cold air that tends to easily accumulate on the lower side can easily accumulate near the ceiling of the space N, and cold air blown out from the operating units 130*k* and 130*l* is prevented from immediately diffusing toward around the floor of the space N. Instead, cold air accumulated near the ceiling will gradually diffuse toward around the floor. Therefore, in this alternative embodiment, the entire space N can be uniformly cooled.

Note that, in the example shown in FIG. 17, as in the alternative embodiment (3), opening and closing of each of the flaps 31*a* to 31*d* of each of the indoor units 130*a*, 130*b*, . . . , and 130*y* is independently controllable, and control is performed such that an air flow from each of the flaps 31*a* to 31*d* of each of the operating units 130*k* and 130*l* is prevented from colliding with each other. As a result, an air flow that moves along the ceiling of the space N in a hovering manner easily flows from the operating units 130*k* and 130*l* toward the adjacent units 130*f* to 130*h*, 130*m*, and 130*p* to 130*r*. Then, cold air from the operating units 130*k* and 130*l* is merged with an air flow flowing downward or obliquely downward from the adjacent units 130*f* to 130*h*, 130*m*, and 130*p* to 130*r*, thus forming a circulating air flow in the space N. Accordingly, it is possible to uniformly cool the entire space N.

Further, in the example shown in FIG. 17, each of the adjacent units 130*f* to 130*h*, 130*m*, and 130*p* to 130*r* is controlled by the adjacent-unit control unit 114 as described below. Specifically, among each of the flaps 31*a* to 31*d* of each of the adjacent units 130*f* to 130*h*, 130*m*, and 130*p* to 130*r*, the adjacent-unit control unit 114 stops air blowing from the flap on the side close to the operating units 130*k* and 130*l* and causes air to be blown out only from the flap farther from the inner space N2 than the suction port 33. Accordingly, each of the adjacent units 130*f* to 130*h*, 130*m*, and 130*p* to 130*r* can easily suck cold air from each of the operating units 130*k* and 130*l* via the suction port 33, and the cold air is blown out from the adjacent units 130*f* to 130*h*, 130*m*, and 130*p* to 130*r*. Thereby, cold air generated in the operating units 130*k* and 130*l* reaches throughout the space N.

Further, in this alternative embodiment, as in the alternative embodiments (5) and (6), the adjacent-unit control unit 114 may control the direction of air from and the air volume of each of the adjacent units 130*f* to 130*h*, 130*m*, and 130*p* to 130*r* based on a difference between the sensible temperature as felt by a living body in the boundary side space N1 and the sensible temperature as felt by a living body in the inner space N2 and/or the comfort in the boundary side space N1. Consequently, it is possible to form a circulating air flow in the space N while directing air blown from the adjacent units 130*f* to 130*h*, 130*m*, and 130*p* to 130*r* toward the living body in the boundary side space N1.

(8)

The air conditioning control device 101 may be a central remote controller for the air conditioner that includes the indoor units 130*a*, 130*b*, . . . , and 130*y*. Consequently, the user can input an operation command to each of the indoor units 130*a*, 130*b*, . . . , and 130*y* via an input unit (not shown) of the air conditioning control device 101. Note that an operation command input via the input unit (not shown) of the air conditioning control device 101 is processed in the same manner as an operation command input via the remote controllers 40*a*, 40*b*, . . . , and 40*y*.

(9)

The above described alternative embodiments (1) to (6) may be combined in any manner.

INDUSTRIAL APPLICABILITY

The present invention has effects that can improve the air conditioning operational efficiency in the space of a portion of a single space having an indoor unit group installed when air conditioning is needed only in the space of the portion, and can facilitate energy conservation. The present invention is useful as an air conditioning control device and an air conditioning control method in which the operation of the indoor unit group constituted by a plurality of indoor units of an air conditioner installed in the single space is collectively controlled.

What is claimed is:

1. An air conditioning control device adapted to collectively control operation of an indoor unit group including a plurality of indoor units of an air conditioner installed in a single space, the air conditioning control device comprising:

an operating-unit specifying unit configured to specify an operating unit from the indoor units included in the indoor unit group, the operating unit performing an air conditioning operation;

an adjacent-unit specifying unit configured to specify an adjacent unit from the indoor units included in the indoor unit group, the adjacent unit being adjacent to the operating unit, and the adjacent unit having a first mode in which the adjacent unit functions as an adjacent unit and a second mode in which the adjacent unit functions as another operating unit which performs a cooling or heating operation;

an operating-unit control unit configured to cause the operating unit to perform the air conditioning operation; and an adjacent-unit control unit configured to cause the adjacent unit to perform an air flow generating operation to generate an air flow that inhibits air conditioned by the air conditioning operation of the operating unit from diffusing from an air conditioning target space forming a portion of the single space and which is targeted by the air conditioning operation of the operating unit.

2. The air conditioning control device according to claim 1, wherein, the air flow generating operation is a thermo-off operation.

3. An air conditioning control device adapted to collectively control operation of an indoor unit group including a plurality of indoor units of an air conditioner installed in a single space, the air conditioning control device comprising:

an operating-unit specifying unit configured to specify an operating unit from the indoor units included in the indoor unit group, the operating unit performing an air conditioning operation;

an adjacent-unit specifying unit configured to specify an adjacent unit from the indoor units included in the indoor unit group, the adjacent unit being adjacent to the operating unit;

an operating-unit control unit configured to cause the operating unit to perform the air conditioning operation; and an adjacent-unit control unit configured to cause the adjacent unit to perform an air flow generating operation to generate an air flow that inhibits air conditioned by the air conditioning operation of the operating unit from diffusing from an air conditioning target space forming a portion of the single space and which is targeted by the air conditioning operation of the operating unit, the air flow generating operation being a mild cooling operation or a mild heating operation.

4. The air conditioning control device according to claim 1, wherein the adjacent unit is installed in a ceiling of the single space, and the air flow generating operation is an air blowing operation to blow air downward or obliquely downward.

5. The air conditioning control device according to claim 1, further comprising an operation command input unit configured to allow a user to input an operation command to the indoor units included in the indoor unit group, wherein the operating-unit specifying unit is configured to specify the operating unit based on the operation command input via the operation command input unit.

6. The air conditioning control device according to claim 1, further comprising a living body location identifying unit configured to identify a location of a living body present in the single space, wherein the operating-unit specifying unit is configured to specify the operating unit based on the location of the living body identified by the living body location identifying unit.

7. An air conditioning control device adapted to collectively control operation of an indoor unit group including a plurality of indoor units of an air conditioner installed in a single space, the air conditioning control device comprising:

an operating-unit specifying unit configured to specify an operating unit from the indoor units included in the indoor unit group, the operating unit performing an air conditioning operation;

an adjacent-unit specifying unit configured to specify an adjacent unit from the indoor units included in the indoor unit group, the adjacent unit being adjacent to the operating unit and including a plurality of air blow-out direction adjusting elements configured to adjust a direction of air blown out therefrom;

an operating-unit control unit configured to cause the operating unit to perform the air conditioning operation; and an adjacent-unit control unit configured to cause the adjacent unit to perform an air flow generating operation to generate an air flow that inhibits air conditioned by the air conditioning operation of the operating unit from diffusing from an air conditioning target space forming a portion of the single space and which is targeted by the air conditioning operation of the operating unit, the air flow generating operation being an operation to generate the air flow by independently controlling the plurality of air blow-out direction adjusting elements such that the adjacent unit blows out air only in a direction toward the an conditioning target space.

8. The air conditioning control device according to claim 1, wherein, certain ones of the plurality of indoor units are specified as operating units by the operating-unit specifying unit, and the adjacent-unit specifying unit is configured to specify only an indoor unit that is not one of the operating units as the adjacent unit from all the indoor units adjacent to at least one of the operating units, and the operating-unit control unit is configured to cause an operating unit adjacent to the adjacent unit to perform the air conditioning operation at reduced performance level compared to an operating unit not adjacent to the adjacent unit.

9. The air conditioning control device according to claim 1 further comprising a memory unit configured to store arrangement information regarding an arrangement of the indoor units included in the indoor unit group in the single space, wherein the adjacent-unit specifying unit is configured to specify the adjacent unit based on the arrangement information stored in the memory unit.

10. The air conditioning control device according to claim 1, wherein the operating unit and the adjacent unit are present in the air conditioning target space.

11. An air conditioning control device adapted to collectively control operation of an indoor unit group including a plurality of indoor units of an air conditioner installed in a single space, the air conditioning control device comprising:

an operating-unit specifying unit configured to specify an operating unit from the indoor units included in the indoor unit group, the operating unit performing an air conditioning operation;

an adjacent-unit specifying unit configured to specify an adjacent unit from the indoor units included in the indoor unit group, the adjacent unit being adjacent to the operating unit;

an operating-unit control unit configured to cause the operating unit to perform the air conditioning operation including a cooling operation; and an adjacent-unit control unit configured to cause the adjacent unit to perform an air flow generating operation to generate an air flow that inhibits air conditioned by the air conditioning operation of the operating unit from diffusing from an air conditioning target space forming a portion of the single space and which is targeted by the air conditioning operation of the operating unit, the operating unit and the adjacent unit being present in the air conditioning target space, and the adjacent-unit control unit being configured to control a direction of air flow from the adjacent unit to be directed toward a living body in a vicinity of the adjacent unit.

12. The air conditioning control device according to claim 10, wherein the adjacent unit is installed in a ceiling of the single space, the operating-unit control unit is configured to cause the operating unit to perform a cooling operation, and the operating-unit control unit is configured to control a direction of air flow from the operating unit to be directed toward the adjacent unit.

13. An air conditioning control device adapted to collectively control operation of an indoor unit group including a plurality of indoor units of an air conditioner installed in a single space, the air conditioning control device comprising:

an operating-unit specifying unit configured to specify an operating unit from the indoor units included in the indoor unit group, the operating unit performing an air conditioning operation;

an adjacent-unit specifying unit configured to specify an adjacent unit from the indoor units included in the indoor unit group, the adjacent unit being adjacent to the operating unit and including a suction port configured to suck air and a plurality of air blow-out direction adjusting elements configured to adjust a direction of air blown out therefrom;

an operating-unit control unit configured to cause the operating unit to perform the air conditioning operation; and an adjacent-unit control unit configured to cause the adjacent unit to perform an air flow generating operation to generate an air flow that inhibits air conditioned by the air conditioning operation of the operating unit from diffusing from an air conditioning target space forming a portion of the single space and which is targeted by the air conditioning operation of the operating unit, the operating unit and the adjacent unit being present in the air conditioning target space, and the air flow generating operation being an operation to generate the air flow only from the air blow-out direction adjusting elements farther from the operating unit than the suction port.

14. An air conditioning control method for collectively controlling operation of an indoor unit group including a plurality of indoor units of an air conditioner installed in a single space, the air conditioning control method comprising:

specifying an operating unit from the indoor units included in the indoor unit group, the operating unit performing an air conditioning operation;

specifying an adjacent unit from the indoor units included in the indoor unit group, the adjacent unit being adjacent to the operating unit, and the adjacent unit having a first mode in which the adjacent unit functions as an adjacent unit and a second mode in which the adjacent unit functions as another operating unit which performs a cooling or heating operation;

controlling the operating unit such that the operating unit performs the air conditioning operation; and controlling the adjacent unit such that the adjacent unit performs an air flow generating operation to generate an air flow that inhibits air conditioned by the air conditioning operation of the operating unit from diffusing from an air conditioning target space forming a portion of the single space and which is targeted by the air conditioning operation of the operating unit.

15. The air conditioning control device according to claim 2, wherein the adjacent unit is installed in a ceiling of the single space, and the air flow generating operation is an air blowing operation to blow air downward or obliquely downward.

16. The air conditioning control device according to claim 3, wherein the adjacent unit is installed in a ceiling of the single space, and the air flow generating operation is an air blowing operation to blow air downward or obliquely downward.

17. The air conditioning control device according to claim 5, further comprising a living body location identifying unit configured to identify a location of a living body present in the single space, wherein the operating-unit specifying unit is configured to specify the operating unit based on the location of the living body identified by the living body location identifying unit.

18. The air conditioning control device according to claim 17, wherein the adjacent unit includes a plurality of air blow-out direction adjusting elements configured to adjust a direction of air blown out therefrom, and the air flow generating operation is an operation to generate the air flow by independently controlling the plurality of air blow-out direction adjusting elements such that the adjacent unit blows out air only in a direction toward the air conditioning target space.

19. The air conditioning control device according to claim 18, wherein, a plurality of indoor units are specified as operating units by the operating-unit specifying unit, and the adjacent-unit specifying unit is configured to specify only an indoor unit that is not one of the operating units as the adjacent unit from all the indoor units adjacent to at least one of the operating units, and the operating-unit control unit is configured to cause an operating unit adjacent to the adjacent unit to perform the air conditioning operation at reduced performance level compared to an indoor unit not adjacent to the adjacent unit.

20. The air conditioning control device according to claim 19 further comprising a memory unit configured to store arrangement information regarding an arrangement of the indoor units included in the indoor unit group in the single space, wherein the adjacent-unit specifying unit is configured to specify the adjacent unit based on the arrangement information stored in the memory unit.

* * * * *